US010907417B2

(12) United States Patent
Brady

(10) Patent No.: US 10,907,417 B2
(45) Date of Patent: Feb. 2, 2021

(54) POLYCRYSTALLINE DIAMOND CHISEL TYPE INSERT FOR USE IN PERCUSSION DRILL BITS EVEN FOR USE IN LARGE HOLE PERCUSSION DRILLING OF OIL WELLS

(71) Applicant: William J Brady, St. Louis, MO (US)

(72) Inventor: William J Brady, St. Louis, MO (US)

( * ) Notice: Subject to any disclaimer, the term of this patent is extended or adjusted under 35 U.S.C. 154(b) by 189 days.

(21) Appl. No.: 15/998,078

(22) Filed: Jun. 25, 2018

(65) Prior Publication Data

US 2018/0313162 A1 Nov. 1, 2018

Related U.S. Application Data

(63) Continuation-in-part of application No. 15/530,418, filed on Jan. 11, 2017, now abandoned, which is a continuation-in-part of application No. 13/987,893, filed on Sep. 16, 2013, now Pat. No. 9,551,189, which is a continuation-in-part of application No. 12/550,093, filed on Aug. 28, 2009, now abandoned, which is a continuation-in-part of application No. 12/273,700, filed on Nov. 19, 2008, now abandoned.

(60) Provisional application No. 61/744,090, filed on Sep. 18, 2012, provisional application No. 61/022,614, filed on Jan. 22, 2008.

(51) Int. Cl.

| | |
|---|---|
| ***E21B 10/58*** | (2006.01) |
| ***E21B 10/46*** | (2006.01) |
| ***E21B 10/36*** | (2006.01) |
| ***E21B 10/55*** | (2006.01) |
| ***E21B 1/00*** | (2006.01) |
| ***E21B 17/10*** | (2006.01) |
| ***E21B 10/567*** | (2006.01) |

(52) U.S. Cl.

CPC ..... *E21B 10/58* (2013.01); *E21B 1/00* (2013.01); *E21B 10/36* (2013.01); *E21B 10/46* (2013.01); *E21B 10/55* (2013.01); *E21B 10/5673* (2013.01); *E21B 17/1092* (2013.01)

(58) Field of Classification Search

CPC ..... E21B 10/36; E21B 10/58

See application file for complete search history.

(56) References Cited

U.S. PATENT DOCUMENTS 2,689,109 A * 9/1954 Curtis ..... E21B 10/56 175/426

2,725,216 A 11/1955 Brown (Continued)

*Primary Examiner* — Robert E Fuller

(74) *Attorney, Agent, or Firm* — Paul M. Denk

(57) ABSTRACT

A polycrystalline diamond drill bit for percussion drilling, in small hole high silica ground is disclosed which has a cutting face having an inner flat face and an outer beveled peripheral surface, a number of first polycrystalline diamond tipped inserts having a first diameter inserted into the inner flat face and the outer beveled peripheral surface, and a number of second polycrystalline diamond tipped inserts having a second diameter inserted into the inner flat face, with the second diameter being different than the first diameter. The cutting angle and the radius of the tip of each insert in addition to the diameter of the inserts, provide for use of a machine thrust pressure and machine torque pressure at low ranges when the PCD bits are used in percussion drilling. The percussion drilling, with larger bits, may be used for rotary oil drilling, and operating at a machine thrust and torque of less than 20 Bar.

23 Claims, 18 Drawing Sheets

(56) References Cited

U.S. PATENT DOCUMENTS

| | | | | |
|---|---|---|---|---|
| 3,382,940 | A * | 5/1968 | Stebley | E21B 10/56 175/426 |
| 3,388,756 | A | 6/1968 | Varel et al. | |
| 3,788,409 | A | 1/1974 | Curington | |
| D340,248 | S | 10/1993 | Brady | |
| D351,174 | S | 10/1994 | Brady | |
| 5,630,479 | A * | 5/1997 | Dennis | E21B 10/5673 175/426 |
| 5,794,728 | A | 8/1998 | Palmberg | |
| 5,875,858 | A | 3/1999 | Brady | |
| 5,944,129 | A | 8/1999 | Jensen | |
| 5,947,215 | A | 9/1999 | Lundell | |
| 5,984,030 | A | 11/1999 | Larsson et al. | |
| D424,579 | S | 5/2000 | Brady | |
| D430,578 | S | 9/2000 | Brady | |
| 6,659,202 | B2 | 12/2003 | Runquist et al. | |
| D487,753 | S | 3/2004 | Brady | |
| D524,333 | S | 7/2006 | Brady | |
| 7,207,402 | B2 | 4/2007 | Bjork | |
| D574,403 | S | 8/2008 | Brady | |
| 8,051,927 | B2 | 11/2011 | Nava | |
| 9,551,189 | B2 | 1/2017 | Brady | |
| 2006/0162965 | A1* | 7/2006 | Hadin | E21B 10/36 175/296 |
| 2006/0180354 | A1 | 8/2006 | Belnap et al. | |
| 2008/0035387 | A1 | 2/2008 | Hall et al. | |
| 2009/0184564 | A1 | 7/2009 | Brady | |
| 2009/0260892 | A1 | 10/2009 | Hisada et al. | |
| 2010/0025114 | A1 | 2/2010 | Brady | |
| 2011/0042146 | A1 | 2/2011 | Lachmann et al. | |
| 2012/0025114 | A1 | 2/2012 | Lymberopoulos et al. | |
| 2014/0182939 | A1 | 7/2014 | Bhatia et al. | |
| 2014/0182947 | A1 | 7/2014 | Bhatia et al. | |
| 2015/0176334 | A1* | 6/2015 | Purcell | E21B 4/06 175/414 |

* cited by examiner

BODY NOMENCLATURE

INSERT NOMENCLATURE

POLYCRYSTALLINE DIAMOND CHISEL TYPE INSERT FOR USE IN PERCUSSION DRILL BITS EVEN FOR USE IN LARGE HOLE PERCUSSION DRILLING OF OIL WELLS

CROSS REFERENCE TO RELATED APPLICATION

This non-provisional patent application claims priority to the provisional patent application having Ser. No. 62/604,269, filed on Jun. 29, 2017; and this application is a continuation-in-part of the non-provisional patent application having Ser. No. 15/530,418, filed on Jan. 11, 2017; and the latter application is a continuation-in-part of the patent application having Ser. No. 13/987,893, filed on Sep. 16, 2013, now U.S. Pat. No. 9,551,189, which is the non-provisional patent application for the provisional application having Ser. No. 61/744,090, filed on Sep. 18, 2012, and this previous application having Ser. No. 13/987,893, claims priority as a continuation-in-part to the patent application having Ser. No. 12/550,093, filed on Aug. 28, 2009, and which application claims priority as a continuation-in-part to the non-provisional patent application having Ser. No. 12/273,700, filed on Nov. 19, 2008, and which application claims priority to the provisional application having Ser. No. 61/022,614, filed on Jan. 22, 2008.

FIELD OF THE DISCLOSURE

This disclosure relates to drill bits, and more specifically to polycrystalline diamond chisel type inserts used for percussion drill bits for use for accelerating drilling, particularly within very hard rock, and high silica ground at very low thrust and torque ranges. This disclosure provides very specific parameters for the drill bits and drill machine settings that comprise a system for drilling, particularly for percussion rotary drilling in oil wells.

BACKGROUND OF THE DISCLOSURE

Tungsten carbide drill bits have been used for drilling into soil and also hard rock, and have been available for many years, have been effective for their routine usage, but they do have a tendency to become dull, or fracture, particularly when drilling into hard rock.

Current tungsten carbide bits tend to dull down very fast in very hard, high silica ground, with a compressive strength of 30,000-60,000 psi.

The drill settings, when using tungsten carbide bits are generally set at 30 Bar or more for the thrust and torque for the first hole or two, then the thrust is increased to the maximum on the drill of approximately 50 Bar, and far above to drive the dull bit into the rock.

Tungsten carbide bits cannot drill efficiently at very low thrust and torque settings in hard rock drilling applications, as the carbide inserts dull down severely, and stop the drill bit from penetrating the ground. Very high thrust and torque settings, sometimes up to 50 Bar, and far above, are required when drilling with these types of carbide bits.

The prior art and use of tungsten carbide insert bit designs has proven to be marginally satisfactory and the design and use of polycrystalline diamond (PCD) type inserts has substantially improved the performance of percussion drill bits. It has taken many years to perfect the design of the PCD bits, as a replacement for carbide tips, particularly since in the PCD bit structure, the range for the dimensions of the inserts, the bit bodies, and the drill settings, are very limited and narrow. Inserts used in prior art could have a very wide range of dimensions, and still be considered acceptable.

Prior art patents or publications include U.S. Pat. No. D574,403 and U.S. Publication No 2009/0184564. Other prior art patents relating to this technology include U.S. Pat. No. 5,944,129, in addition to U.S. Pat. No. 3,788,409. Published Application No. 2014/0182939, and No. 2014/0182947 show other drill bits.

As further commented, carbide bits operate at very high thrust and torque, usually in the range of 30 to 50 Bar or above for thrust, and 30 Bar or above for torque, and their insert tip length is shorter, and there are many more inserts included in the bit body, than are required or needed in the PCD type of percussion drill bit.

Carbide bits dull down fairly fast, particularly in abrasive rock, thus slowing down the penetration rate, and require a significant elevation of thrust and torque, in order to achieve any continuous drilling. Furthermore, it has been experienced that carbide bits wear down 10 to 15 times faster than a PCD drill bit, and are 30% to 50% slower in drilling penetration rates. This make for quite a difference.

Through testing, it has been determined that the normal time to drill a 50 hole round within hard rock, using the carbide drill bit, was in excess of three hours, but utilizing a PCD insert drill bit, could achieve the same drilling of a 50 hole round in a time between about one hour and one and a half hours. PCD bits complete a drilling operation using 70% less thrust and 60% less torque.

The usage of PCD bits, in comparison to carbide bits, found that the PCD percussion drill bits were more productive; at far less thrust and torque parameters, than the carbide bits.

Furthermore, because there are fewer PCD bits to change out due to little or no dulling, during prolonged usage, there is a lesser chance of injuries to the miner, and workers handling such equipment.

Because of the reduction in thrust and torque forces required, up to approximately the 70% range, when drilling with PCD insert drill bits in comparison to the use of carbide bits, there is less heat buildup in the drill steel sections and there is a less torsional forces exerted on the steel sections that can cause fatigue and failure, and therefore, the drill steel section life of the entire equipment is vastly improved using the PCD insert bits.

Furthermore, because of the very low thrust and low torque that is used when drilling with PCD double chisel insert bits or modified double chisel bits, as has been found through experimentation, there is less stress on the hydraulic components of the machinery, that there is less wear on the drilling machine and there is less heat buildup in the drill steel sections, as explained, when utilizing the PCD bits in comparison with carbide bits.

Other patents relating to the subject matter of this disclosure, as previously briefly reviewed, can be seen in the earlier patents to the inventor herein, U.S. Pat. No. D574,403, to Brady, upon the development relating to Hard Rock Percussion Drill Bit With Parabolic PCD Inserts; a further published application to Mr. Brady, U.S. 2009/0184564, upon PCD Percussion Drill Bit; the prior published application to the inventor herein entitled PCD Percussion Drill Bit, No. U.S. 2010/0025114, disclosing related technology.

In addition, other prior patents to Larsson such as, U.S. Pat. No. 5,984,030, entitled Rock Drilling Tool, Drill Bit and A Method of Transferring Percussive Energy; in addition to the patent to Curington, No. U.S. Pat. No. 3,788,409, also upon Percussion Bits; and the patent to Lundell, U.S. Pat.

No. 5,947,215, pertaining to Diamond Enhanced Rock Drill Bit for Percussive Drilling, all disclose related technology.

Other related patents or published applications include U.S. Pat. No. 8,051,927; published application No. 2011/0042146; U.S. Pat. No. 5,794,728; U.S. Pat. No. 7,207,402; and published application No. 2009/0260892. These all show similar technology.

PCD inserts have been used in the oil drilling industry, in the past. Some of the inserts where dome shaped PCD inserts, and even some chisel type PCD inserts have been used with the Tri Cone type of rotary drilling, in oil wells, but they operated at very high thrust and torque levels, as to be reviewed herein, and any experimentation in using such bits for percussion drilling, many if not most of the inserts would shear off, particularly at the high thrust and torque levels, making them ineffective for usage. The current invention has designed PCD chisel type inserts for use in percussion drilling, and has found them to be highly effective when only used at a very low thrust and torque machine setting.

Finally, it was observed during experimentation, that the powder crews, when depositing their explosives within the drilled holes, that there was a very significant reduction of cuttings left in the hole that were drilled with the PCD bits as compared with the carbide bit drilled holes, and this resulted in significantly less time cleaning the holes with a spoon, during the performance of the crews' duties.

It can be seen that when compared to the prior art style of carbide bits,. that the PCD bits have far more advantages, which have been identified during experimentation and testing, at very significant cost reduction advantages for the mine. Production is nearly doubled with the use of the PCD drill bit. The bit cost per foot of hole is reduced, drilling time of the holes is significantly reduced and maintenance costs are minimized.

SUMMARY OF THE DISCLOSURE

This disclosure contemplates the formation of polycrystalline diamond percussion drill bits, either incorporating PCD chisel contoured inserts, or in combination with PCD conical inserts, and generally used in drill bits for percussion drilling, and can be used in drilling in the mining industry, and the oil industry. All operate at low thrust and torque.

These polycrystalline diamond percussion drill bits can be used for percussion drilling in hard rock at very low thrust and torque, as never previously contemplated, and can also be used in sizes up to 30" in diameter, and employed at the same low thrust and torque for percussion rotary drilling, of the down the hole method, or top hammer percussion drilling, in all types of percussion drilling applications in mining, tunneling, water well and oil well drilling, and for large hole drilling applications, even when encountering hard rock in the process.

These drill bits may be of a double chisel or modified double chisel design, having cutting faces designed to reduce the cost of drilling and to improve drilling penetration rates over the older style tungsten carbide bits. With the PCD type of chisel bit designs, the machine thrust pressure is lowered to the practical range of 10 Bar-20 Bar max, and the machine torque pressure is reduced to 5 Bar-15 Bar max. At these drill settings, the thrust is reduced significantly, even by as much as 70%, and the torque pressure is reduced to around 60%, and the PCD drill bits continue to drill every hole at about the same speed. The PCD bits, whether of the chisel or conical design, stay sharp and show very little or no dulling, even after drilling hundreds of feet of hole into hard rock or high silica ground. The low thrust and torque settings are exclusive for PCD diamond insert percussion drill bits only, to attain maximum penetration rates and maximum bit life. The disclosure described herein generally relates to small diameter PCD percussion drill bits, that incorporate PCD tipped chisel type designed inserts, and the bits are generally within the range of between about 1⅜" to 30" diameters, or 2" to 24", or even as large as said 30", diameters particularly when employed in the percussion rotary drilling.

Three-winging and four-winging bits were tested using the PCD inserts, and were made similar to bits made with tungsten carbide inserts. These PCD bits designs either failed or drilled slower. The two wing double chisel bit design was then tried and the results were outstanding and completely unexpected. The penetration rates achieved were two to four times faster, and the life was 10 to 15 times longer than the carbide bits, and the inserts, during experimentation showed little or no dulling or wear even after drilling over 450 feet of hole in the extremely hard, high silica ground.

PCD bits with bigger inserts and the larger specific range of radius on the tip of the conical insert was tested several times. The PCD bits made with the larger inserts and larger radius on the tip of the inserts drilled 40% slower than the PCD bits made with a sharper tip. If the tip is too sharp, there is insert failure due to shearing of the insert tip. If the tip is too blunt, it acts like a dull carbide tip. The dimension range is narrow for these PCD inserts of this disclosure.

After testing of various dimensions for the PCD inserts, the parameters where established for the inserts and the bit bodies. There is a narrow range for the inserts, and bit body dimensions, and they need to all be balanced with the parameters set for the low thrust and low torque settings on the drill, to attain maximum performance when used in percussion drilling.

A PCD diamond percussion drill bit means can be used for blast hole drilling and roof bolt drilling. The PCD drill bit is the only drill bit to use extremely low thrust and low torque when drilling very hard, high silica rock. The PCD drill bits have the following advantages:

1. PCD bits are more productive than carbide bits and show little or no dulling wear on the inserts.
2. PCD bits drill 2-4 times faster than carbide bits.
3. PCD bits last 10-15 times longer than carbide bits.
4. Regarding safety, PCD bits reduce hand injuries, because fewer bit changes are required.
5. The drill steel, striking Bar and coupling life is increased because of the low thrust and torque used when drilling with PCD drill bits.
6. There is reduced maintenance of the drill because of the low thrust and low torque requirements.
7. Bit costs and drilling costs are reduced because of the high footage attained on the PCD percussion drill bits and the fast penetration rate achieved.
8. The application of PCD chisel inserts within the drill bit provides greater penetration and slicing of the earth when such percussion drill bits are used in the drilling of very hard, high silica rock, or even when used in percussion rotary drilling of oil wells.

The present disclosure shows how critical dimensions are when drilling with PCD inserts. With the proper dimensions, thrust and torque set to the proper settings, the PCD double chisel and modified double chisel designed bits have proven to exceed the performance of all prior art designs.

And in the design of PCD inserts, when the inserts are made with a 0.020 to 0.030 inch thick PCD coating of diamond on the tip of the insert, whether it be of the chisel or conical design, the following ranges have been found for the design and manufacture of the percussion drill bit for their most effective applications:

| Range Claimed for Range Optimal PCD Conical Inserts | Range Dimensions | Optimal Dimensions |
|---|---|---|
| OAL of Insert | .490"-.650" | .543"-.600" |
| Diameter of Insert | .3000"-.4200" | .3100" or .3777" |
| Tip Length | .200"-.260" | .215"-.245" |
| Tip Angle | 15.00°-35.00° | 15.00°-30.00° |
| Tip Radius | .100" R-.145" R | .115" R-136" R |
| Grip Length | .290"-.420" | .313"-.400" |

Some bits require more than one length of insert for assembly.

| Range Claimed for Range Optimal PCD Conical Inserts | Range Dimensions | Optimal Dimensions |
|---|---|---|
| OAL of Insert | .600"-.750" | .685" |
| Diameter of Insert | .3900"-.4900" | .4442" |
| Tip Length | .250"-.350" | .315" |
| Tip Angle | 15.00°-35.00° | 20.00°-30.00° |
| Tip Radius | .120" R-.155" R | .136" R |
| Grip Length | .300"-.450" | .357"-.450" |

Some bits require more than one length of insert for assembly.

| Range Claimed for Range Optimal PCD Conical Inserts | Range Dimensions | Optimal Dimensions |
|---|---|---|
| OAL of Insert | .625"-.785" | .685" |
| Diameter of Insert | .4800"-.5200" | .5002" |
| Tip Length | .260"-.335" | .300"-.310" |
| Tip Angle | 28.00°-40.00° | 28.00°-32.00° |
| Tip Radius | .135" R-.170" R | .150" R |
| Grip Length.330"-.550" | .330"-.550" | .435" .600" |

Some bits require more than one length of insert for assembly.

Preferred Ranges Claimed for PCD Chisel Inserts

| | |
|---|---|
| PCD Insert diameter range | .300" to .750" |
| PCD Insert grip length | .300" to .600" |
| PCD Insert tip length | .250" to .360" |
| PCD Tip radius on Chisel Inserts | .04" to .135" |
| PCD Tip length in a range of | .225" to .375" |
| PCD Coating thickness on Tip of inserts | .010" to .035" |
| PCD Insert diameter range | .300" to .750" |
| PCD Insert grip length | .300" to .600" |
| PCD Insert tip length | .250" to .360" |
| PCD Tip radius on Conical Inserts | .115" to .170" |
| PCD Tip length in a range of | .225" to .400" |
| PCD Coating thickness on Tip of inserts | .010" to .035" |

Preferred Further Ranges Claimed for PCD Conical Inserts

A system of drilling, whereby, low machine thrust pressures of 10 Bar up to 25 Bar and low machine torque pressures, of 8 Bar to 20 Bar are used in combination with PCD conical inserts and/or PCD chisel insert drill bits to maximize their performance.

After considerable research and development, the critical insert and PCD bit dimensions where established for the drill bits as described herein, and then the drill setting parameters where established, as shown, through such experimentation. The drill settings are set far below what a carbide bit can operate effectively at, and this was not obvious to this inventor, in determining what the parameters should be. As previously reviewed, carbide bits in hard, high silica rock need at least 30 Bar of machine thrust pressure, and 30 Bar of machine torque pressure, to drill the first couple of holes. As they dull down, the machine thrust pressure needs to be increased to 50 Bar. The PCD double chisel bit design, to be described herein, required only 8 to 15 Bar of machine torque pressure, and 12 to 15 Bar of machine thrust pressure, to drill with maximum penetration rates and efficiency. Thus, drilling with the PCD insert drill bits takes about 70% less thrust, and 60% less torque than a carbide bit. PCD bits were found to drill two to four times faster than the carbide bits, and are capable of drilling, and they do it with far less thrust and torque. This unique feature of very low thrust and very low torque when drilling with PCD insert percussion drill bits is a significant improvement in this art. These very low drill settings are unique for percussion drilling with PCD inserts only. Carbide bits cannot perform well at these low settings, and when they get slightly dull, the carbide bits will just slow or stop penetrating the rock at these low settings and will just spin in the drilled hole. These very low drill settings are unique for drilling with the PCD insert bits only.

As explained in the ranges listed above, the combination of features that are unique to bits made with PCD inserts, and the drill settings are as follows. The PCD insert tip length is significant. The PCD insert tip radius is significant. The PCD insert tip angle is critical. The PCD insert grip length is necessary. The 25 bit body gauge angle in combination with the tip length requires careful analysis when making the PCD insert. For the disclosure herein, the double chisel design has been found most effective when used on bits from the 1¼' to 2¼ in gauge sizes. The modified double chisel design when used on bits from 2½ to 3½ gauge sizes is essential for maximum and outstanding performance. The drill settings, as previously explained, for machine torque pressure, should be set and 8 to 15 Bar maximum. The machine thrust pressure setting is set at 12 to 15 Bar maximum, during a drilling performance.

When the parameters are established for the PCD inserts, in the formation of the bits, during their usage, it has been found that the inserts stay very sharp even after drilling hundreds of feet of hole in high silica, high compressive strength rock, achieving such even at these types of low torque and thrust settings.

In the inventor's sixty years of designing carbide rotary and percussion drill bits, he has never seen a percussion drill bit made that compares to the percussion PCD double chisel bit design for performance as described herein. The specific body angles, the PCD inserts with very specific lengths, tops, angles and radii, have performed extremely well, and far outperform the carbide inserts which were/are standard in the art. The double chisel bit design requires that a very low torque and very low thrust be used to drill efficiently, and at these low levels of operation, the bits just do not wear out, and have a far more extended life than what can be obtained from a carbide type of bit. Percussion bits made with PCD inserts using the specific insert dimensions, bit bodies, and all the other dimensions identified herein, are believed to be quite unique in the art, and have proven to out perform carbide bits, particularly when used for drilling continuously in hard rock.

The PCD chisel and conical PCD inserts used in the current design, the PCD bits range in sizes from 2½ to 30", and are made with the latest advanced transition technology in the manufacture of PCD inserts. The transition technology of the improvements provided herein, is where the manufacture uses three or more layers of diamond that form a tough, medium tough and very hard layer of diamond, and has made it possible to use these inserts for percussion drilling applications in mining, tunneling, water well, and oil well drilling, even for large hole drilling applications. These inserts may have a PCD coating that ranges from 0.030" to 0.060" in diamond thickness. The coating is very tough, and wear resistant even in high silica rock. The impact strength may be as high as 700 joules. These particular hammer bits, may be used for both top hammer percussion drilling, and also for down the hole percussion drilling. The down the hole type of bits, incorporating PCD inserts, can be in sizes of 1⅜" to 30" in diameter, and the down the hole percussion bits, for all sizes from 3½" to 30" can be used for percussion drilling. Life of the PCD inserts has been greatly improved. These improvements have made it possible to use PCD inserts in percussion drilling applications, where previously they were only used in rotary drilling applications. Thus, this is a utility application that was previously not known or used with any PCD type of chisel inserts. These PCD type of chisel inserts now exhibit a very high toughness through the application of its multilayered diamond coatings to the chisel inserts, which now makes these types of inserts, when applied to even larger bits, as identified herein, readily applicable for use for drilling, down the hole percussion drilling, top hammer percussion drilling, and all operated at very low thrust and torque, as described herein, which had heretofore never been considered, or achieved.

Heretofore, where a PCD insert were used in the Tri Cone style of rotary drilling, their machine thrust pressure levels where up at the 700 psi to 4000 psi range, which means their machine thrust pressure levels where within a range of 48 bar to 275 bar. This is way too high for percussion drilling and will shear the inserts during usage at these high psi ranges. In addition, the machine torque pressure encountered in Tri Cone rotary drill bits, when used, was in the range of 2000 psi, which converts to 350 to 2000 Bar, which if used in percussion drilling, would shear immediately, and fail, during such applications. The Tri Cone style of bit just would not work at the high thrust and high torque levels when applied for percussion drilling, and the only way such can operate, is at the low thrust and torque as specified in this application.

It is, therefore, the principle object of this disclosure to provide a polycrystalline diamond percussion drill bit, where its inserts are formed within specific ranges of dimensions that have been found, through research and testing, to provide the most effective and efficient percussion bit particularly when used for drilling within high silica.

A further benefit of this invention is that the PCD drill bits may be used for both top hammer and down-the-hole (DTH) hammer percussion drilling applications. The top hammer type of bits, incorporate PCD inserts, that can be in sizes of 1⅜" to 10" in diameter, and the down-the-hole percussion bits, from all sizes from 3½" to 30", for percussion drilling, can be used. This transition improvements have made it possible to use PCD inserts in percussion drilling applications, where previously they where only used in rotary drilling applications.

Another object of this disclosure is to provide a designed bit body for a drill bit in which precisely manufactured and mounted polycrystalline diamond chisel type inserts are located to provide a bit for high efficiency usage.

Another object of this disclosure is to form and provide drill bits that produce double chisel or modified double chisel cutting effects in usage, and can have a diameter range of 1¼" to as high as 30", but do require that a very low machine thrust pressure and very low machine torque pressure, in bar readings, be established during percussion drilling operations.

A further object of this disclosure is to provide the usage and application of PCD inserts, either of the chisel design, or a combination of chisel and conical designed inserts, coated with the polycrystalline diamond at the thickness as previously specified, to enhance and accelerate the drilling operation into hard earth, but at much lower thrust and torque settings than as previously applied.

To add more specifically to the summary of the concept of this disclosure, as an improvement over prior designs, the following parameters for the chisel and conical PCD inserts for percussion drilling can be explained as follows. This application covers the PCD inserts for percussion drill bits in sizes from 1¼ to 8" to 30" in diameter, and which requires low machine thrust pressure and low machine torque pressure in Bar readings.

The Tri Cone style of bit, in rotary drilling, requires the high thrust and high torque to function properly with any PCD inserts, but in a percussion drilling application, the operation requires only a very low thrust and very low torque to prevent the insert shearing. It has been noted, through experimentation, that the drill bits having an outer beveled reamer segment, for the surface of the bit, that when PCD type inserts are provided, and operate for Tri Cone style rotary drilling, these peripheral inserts shear off, after short time usage, down to the surface of the bit. That has been totally unacceptable for drilling operations.

The angular setting of the chisel inserts should preferably be at an approximate 10° to 40° angle from the vertical axis when viewed from the plan of the bit.

The more specific parameters which must be emphasized more fully for the inserts for the PCD conical and chisel type percussion drill bits applications are as follows:

| | |
|---|---|
| PCD Insert diameter range | .300" to .750" |
| PCD Insert grip length | .300" to .600" |
| PCD Insert tip length | .250" to .360" |
| PCD Tip radius on Conical Inserts | .115" to .170" |
| PCD Tip radius Chisel inserts | .04 to .135" |
| PCD Tip length in a range of | .225" to .400" |
| PCD Coating thickness on Tip of inserts | .010" to .035" |

PCD inserts may very in size, depending upon the gauged diameter of the PCD drill bit being made. Any combination of lengths may be used in a single bit as may be required.

Any carbide bit designed today, can be used and the carbide inserts replaced with a PCD conical insert, but the usage of the PCD chisel type inserts require a design unique to the industry. They require specific angular settings for each insert, especially in large diameter drill bits, of the 3½" to 30", or more, in size in diameter.

All bits incorporating PCD chisel and conical inserts require a low machine thrust pressure and a low torque machine pressure to function properly and effectively, in percussion drilling, unlike in the prior art.

PCD flat chisel type inserts and PCD conical inserts have been used in rotary drill bits for several years, where there is no percussion impacting the inserts of the drill bit. Only heavy downward pressure and rotation are applied to the PCD inserts in a Tri Cone, gear type, or the winged PCD flat insert drag bits, for cutting the rock.

This disclosure utilizes conical shaped inserts with a PCD coating on the top, on a cylindrical body, or a PCD chisel shaped top on a cylindrical insert for percussion drilling.

The design of percussion drill bits using chisel type inserts by the disclosure, is unique to the percussion drill bit industry. Only since it was discovered, that PCD percussion drill bits require a low machine thrust pressure and a low machine torque pressure, has it been possible, to use PCD conical and chisel type inserts for percussion drilling.

The design of the chisel PCD inserts may be used in most bit designs to replace the carbide inserts currently used, to increase bit life, to increase penetration rates and reduce down time changing bits. However, the PCD chisel inserts should be placed, so that they are rotary plowing or slicing and cutting the rock as well as cutting the rock and ground with the hammer impacts.

From early testing of the chisel bit design, it was obvious that the penetration rate is nearly twice as fast as a carbide bit of similar size. The outer gauge inserts of carbide, develop a negative clearance angle on the insert, and require the thrust and torque to be increased to the maximum settings on the drill as they dull down.

The PCD bits start with low thrust and low torque settings and rarely need to be changed during the life of the PCD drill bit as the diamond table does not dull down and pinch in the hole like a carbide bit. The penetration rate over the life of the PCD insert bits is nearly constant, whereas, the penetration rate of the carbide insert bits start to slow immediately upon drilling hard rock, and requires the thrust and torque to be increased as the carbide bit dulls down. Testing of penetration rates for a carbide bit started at 2.15 min/hole at 30 Bar thrust and torque and dropped to 6.45 min/hole, at 50 Bar thrust and 40 Bar torque, by the time seven holes were drilled in hard, high silica ground.

In contrast, the PCD bits drilled at a rate of 1 minute 27 seconds to 1 minute 58 seconds at 15 Bar thrust and 10 Bar torque over 95 holes. The machine thrust and torque pressures never needed to be increased for maximum drilling performance with PCD insert drill bits.

Holes drilled with PCD insert bits, are cleaner of cuttings remaining in the hole after drilling and reduces the time spooning the debris out of the drilled holes before loading with prills.

Mine production can be nearly doubled by just changing from carbide drill bits to PCD drill bits, and using the low parameters for machine torque pressure, 8 Bar to 20 Bar and machine thrust pressure, 10 Bar to 25 Bar as defined by testing. If high thrust machine pressure, 30 Bar-50 Bar, and high machine torque pressure, 30-50 Bar are used with PCD insert drill bits, insert shearing is likely to occur, resulting in loss of an expensive drill bit. Holes drilled with high thrust and torque pressures, will retain more cuttings in the hole and require more time spooning cuttings from the hole before loading can be done.

The combination drill bit using the PCD chisel type insets and PCD conical inserts increases the penetration rates substantially and requires 50% to 70% less machine thrust pressure and machine torque pressure than carbide drill bits.

The action of the two PCD insert types, provide yet, another and faster way to drill. The conical inserts fracture the rock with each blow of the drill hammer. The wide PCD chisel insert also fractures the rock but the plowing action of the PCD chisel inserts, remove more of the rock kerf from the hole, with each impact of the drill hammer. When these PCD chisel inserts, are set an angle to attain a slicing action, the chisel inserts are not perpendicular to the direction of rotation but set an angle, in a range of 0.degree. to 40.degree. along the angular arc of rotation. They are set at an angle to the arc of rotation.

The PCD inserts can be set as above, then the chisel cutting edge is skewed or pivoted to 0° to 12°, to the right to provide a slicing action. This skew reduces the torque pressure on the chisel type insert and helps to prevent insert breakage.

All conical or chisel PCD drill bits must have large flutes and large air holes, 2-5 holes, to allow the cutting to be rapidly flushed from the face of the drill bit so that they are not pulverized before being flushed from the hole and the face of the bit.

An air mist system or 100% water may be used for cooling the PCD inserts and flushing of the cuttings from the drilled hole. Holes in each bit body, can vary in size from 3/16" to 1". The number of holes will vary from two (2) to five (5) flushing holes per PCD bit. Always use the largest holes possible to assure maximum flushing of the cuttings from the drilled hole.

Bits with a full round face are not as effective in drilling as the bits designed with an X face because they tend to have less clearance for the cut rock to flush from the face of the drill bit and re-drill or pulverize the cuttings before they are flushed from the hole. All PCD bit designs will drill, but to attain maximum penetration rate possible, the X design was the fastest in the testing program. All PCD bits, utilizing PCD conical and chisel type inserts, only use low thrust and low torque pressures, so as to prevent the PCD inserts from breakage.

To provide a further explanation relating to the improvements made in the concept of this disclosure, which adds the addition of the PCD chisel type design, reference must be made to the prior application of the applicant, Ser. No. 13/987,893, which is now U.S. Pat. No. 9,551,189. That application, for which this current application claims priority, is intended to be fully incorporated herein by reference into this application, and to add to its disclosure of the technology involved.

For example, in referring to the drawings, and in particular FIG. 9, therein is shown a part of a bit body that is applied to the drill shaft for the drilling system, and it discloses the general parameters for the shape of the cutting face for the bit, when it is manufactured and assembled. As can be seen, the body 1 includes its cutting face 2, and has a beveled angle for the cutting face, as noted at 3, which surrounds the circumference of the cutting face 2. The various parameters for the body angle, the gauged diameter, and the center face for the cutting face 2, are shown and described herein, and have previously been summarized in the incorporated reference.

FIG. 10 shows an example of a PCD insert 4, of the conical type, and the inserts, for this embodiment, include a gripping portion 5, which is generally formed of tungsten carbide, and the parameters for its dimension can be seen and summarized and as noted herein. The formed tip 6 for the insert 4, and the concept of the usage of conical inserts in this disclosure, in combination with the chisel design, is the high pressure formation and application of the polycrystalline diamond structure to the insert tip, as will be noted. The insert tip is applied by high pressure and heat to the tungsten carbide tip portion of the insert 4, and is formed to very specific radius, at the tip, and has specific tip angles, in addition to length, all as previously summarized when identifying the ranges for the formation of the conical inserts, and their tip length, tip angles, tip radius, and grip length. The overall diameters for the conical inserts were also reviewed, as previously summarized.

FIG. 11 shows an entire bit body 7, and also discloses the cutting face 8, in addition to the concave clearance portions 9, for the shown bit. Internally of the body is a cavity 10, that communicates with a reduced diameter aperture 11, which conveys the cleaning fluids, such as water, to the forward portion of the bit, and exists under pressure from select apertures, such as the side openings 12, as noted within the side of the shown bit. There are actually a pair of such openings formed in the bit body, for use for injection of fluids, to flush away the drilled earth. This allows for the discharge of fluid, such as water, under pressure, to help clean out the cutting debris, formed during a drilling operation, and forces it to flow upwardly along the concave cavities 9, and up the sides of the drill shaft, for discharge from the hole being drilled, during the drilling operation. While the beveled face for the bit is shown at 28°, it generally will be between 25° to 32° of incline.

The actual configuration of the conical style of insert, as previously summarized in FIG. 10, can also be seen in FIGS. 12A and 12B, in addition to FIG. 13, that shows the insert body, with the polycrystalline applied to its tip, for use in combination with the chisel type PCD bits, as to be described hereinafter within this application.

This provides a summary of the concept of this disclosure, and the improvements made to percussion drilling, through the usage and application of a combination of chisel type PCD inserts for a drill bit body, with PCD conical drill bits, or the application of the chisel type drill bits alone.

These and other objects may become more apparent to those skilled in the art upon review of the summary of the disclosure as provided herein, and upon undertaking a study of the description of its preferred embodiments, in view of the drawings.

DESCRIPTION OF THE PREFERRED EMBODIMENT

This disclosure provides an advancement to the art of percussion drilling, and adds to the concept of utilizing polycrystalline diamond percussion drill bits, where the various inserts are coated with layers of PCD, in order to provide a far more durable cutting face for the bit, when it is used in percussion drilling within very hard soil, such as hard rock, or high silica ground. In addition, the PCD bits of this invention find effectiveness when used in percussion drilling. Even effective in drilling for oil. More specifically, this disclosure includes the application of inserts, into percussion drill bits, of a chisel type of design, which are polycrystalline diamond coated, and can be used in combination with PCD carbide conical tips, or a plurality of the chisel type of inserts, when applied to the drill bit, that can be used independently. In any event, in the use of the chisel type PCD inserts, whether alone, or in combination with the conical PCD drill bits, the percussion drilling operation is far more efficient, much more durable for long lasting life of the bits, and in addition, can be operated at much lower torque and thrust pressures, than when the standard type of carbide inserts are used in drill bits, for related drilling operations.

Figure 1A:
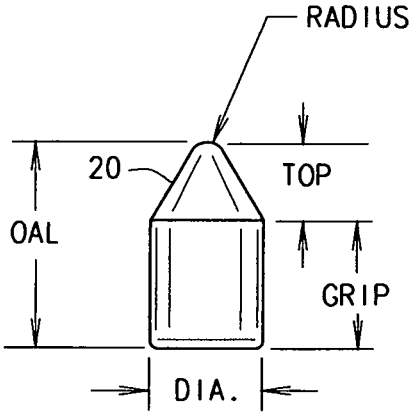
FIGS. 1A through FIG. 1D show, respectively, a side view, front view, and top view for the multi angle chisel design for a PCD insert.
Figure 1B:
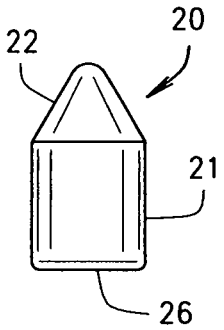
Figure 1C:
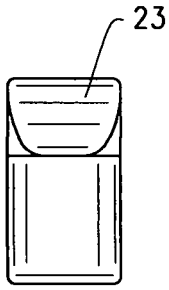
Figure 1D:
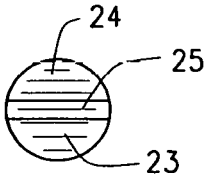

More specifically, in referring to FIGS. 1A through 1D, a chisel type of PCD insert 20, can be seen. The insert 20 includes a gripping portion 21, in its lower segment, and has an upper contoured tip 22 which, as can be seen in FIG. 1B, has a pair of inclined surfaces, one as shown at 23, as noted in FIG. 1C. There are a pair of such inclined surfaces, as at 23 and 24, which incline upwardly, towards an upper widened vertex, as can be noted at 25, and which generally extends from side to side across the top of the insert, as seen in FIG. 1D. The gripping portion 21 has a bottom 26 where there is a slight bevel or radius, as noted, and this is to facilitate the insertion of a number of the inserts 20 into the drill bit, when the bit is being assembled, for use for a drilling operation. The various parameters for the PCD chisel and conical insert, when used in the form of a chisel insert, as at 20, in the preferred embodiments, can have the following range of dimensions:

Insert Parameters for PCD Conical and Chisel Type Percussion Drill Bit Applications

| | |
|---|---|
| PCD Insert diameter range | .300" to .750" |
| PCD Insert grip length | .300" to .600" |
| PCD Insert tip length | .250" to .360" |
| PCD Tip radius range Conical Inserts | .125" to .170" |
| PCD Tip radius range Chisel Inserts. | 04" to .135" |
| PCD tip length in a range of | .225" to .375" |
| PCD Coating thickness on Tip of Inserts. | .010" to .060" |

Figure 1E:
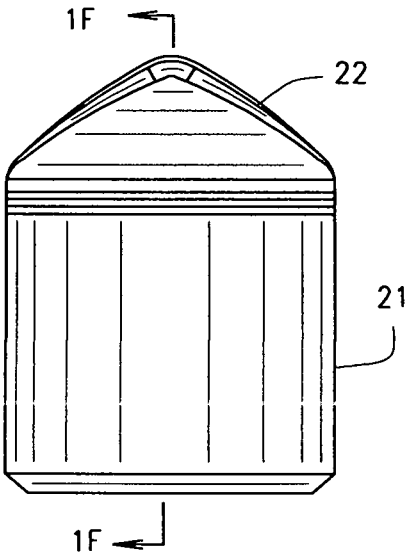
FIG. 1E shows a side view of the insert, disclosing specific dimensions to its various angles upon its cutting tip.
Figure 1F:
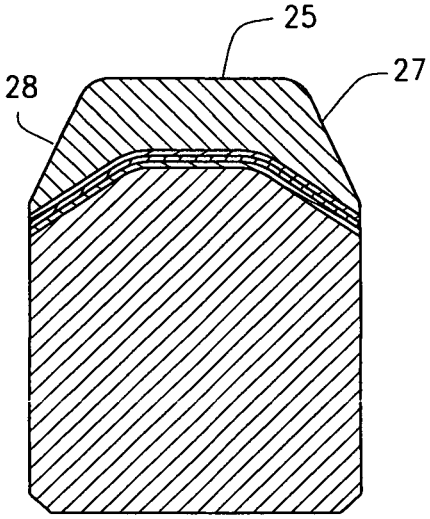
FIG. 1F provides a transverse sectional view taken through the chisel bit along lines 1F-1F of FIG. 1E.

A typical example of the dimensions for the specifically applied chisel form of insert, can be seen in FIGS. 1E and 1F. As can be noted, it includes its base portion 21, its top portion 22, and it is this top portion that is coated with the polycrystalline diamond material, and generally the coating thickness is to that range as previously explained, approximately 0.010" to 0.060", in its application. And, in this embodiment, the top edge 25 extends transversely across the width of the insert, and it may have slightly inclined side edges, as at 27 and 28, in order to eliminate any sharpened edges that may possibly wear quicker during usage of the drill bit in which these chisel inserts locate, for percussion drilling usage.

In the application of these PCD chisel inserts, within drill bits, their primary usage can be noted in FIGS. 2A through 2D. As noted, as in FIG. 2A, the drill bit 29 contains a pair of PCD chisel inserts, as noted at 30 and 31. In this particular instance, the upper ridge or vertex of the inserts, as at 25, are arranged on an angle with respect to the radial dimension of the insert, and in this instance, the radial dimension would be the perpendicular radius to the outer arc of rotation of the drill bit, and as noted, the chisel inserts are arranged at a negative slicing angle of approximately 10°, off the radius, as shown. This means when the drill bit is rotated in the clockwise direction, the slicing of the earth due to the percussion impacting of the drill bit into the earth will generally force the debris towards the outer edge of the bit, as can be understood.

Figure 2A:
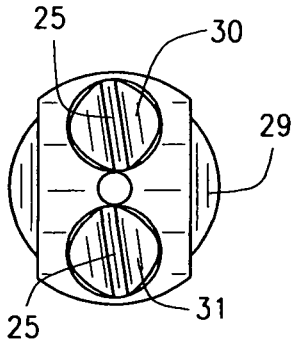
FIG. 2A shows a top view of the application of a pair of PCD chisel inserts applied in a negative slicing angle within a percussion drill bit.
Figure 2B:
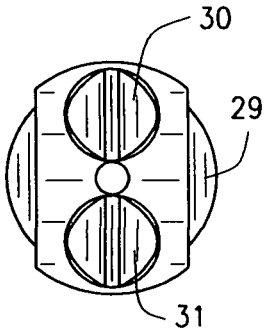
FIG. 2B provides a top view of the application of a pair of PCD chisel inserts into a percussion drill bit and arranged at a 0° angle to provide a plowing type of cutting of earth during usage.
Figure 2C:
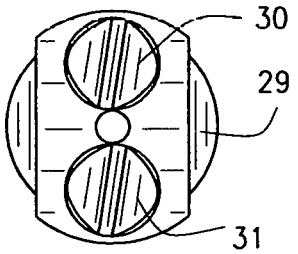
FIG. 2C provides a top view of a pair of PCD inserts applied to a percussion drill bit and arranged at a positive slicing angle of approximately 10.degree. when used in percussion drilling; The angle of degree, as noted is off the vertical of the bit as shown in this FIG.

On the other hand, as can be seen in FIG. 2C, the chisel inserts are arranged, in this embodiment, in a positive 10° angle, off of the radius of the bit, and therefore furnishes a positive slicing action into the earth, when the drill bit is impacted and rotated in the clockwise direction, during a percussion drilling operation, and therefor, the chisel upper surface 25 has a tendency to not only ground into the hard rock, but as it does so, urges any debris inwardly, when the drill bit is continued in its rotation in that clockwise direction, during percussion drilling operations.

This is all distinguish from the use of the chisel inserts, as noted in FIG. 2B, the upper edges of the chisel inserts are arranged along the radius of the drill bit 29 as can be seen. Thus, there is 0° angle between the installed chisel inserts, within the bit body, and thus, the chisel inserts simply plow the surface of the ground being drilled, does not have a tendency to achieve any slicing of the earth, or its movement, other than simply through a plowing action when the bit body is still rotated in its clockwise direction.

Figure 2D:
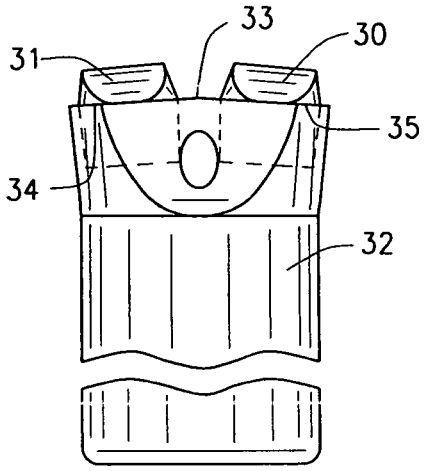
FIG. 2D provides a front view of a percussion drill bit having a pair of the PCD chisel inserts arranged along the double taper of the top of the shown drill bit.

FIG. 2D shows an example of the bit body 32 of one design, where the upper surface of the bit body is formed of approximately three surfaces, a center flat surface 33 and a pair of integral inclined surfaces 34 and 35 and into which the chisel type of inserts 30 and 31 are inserted and installed within the drill bit 32.

Once again, all of these various chisel inserts, regardless to what angle they are applied within their drill bit body, are coated, upon, their tip length, as previously summarized at 6, with the polycrystalline diamond composition, to add to the hardness of the drill bit, through its usage of PCD inserts, of the types as previously described, whether they be of the chisel type, or the conical form of insert.

Figure 3:
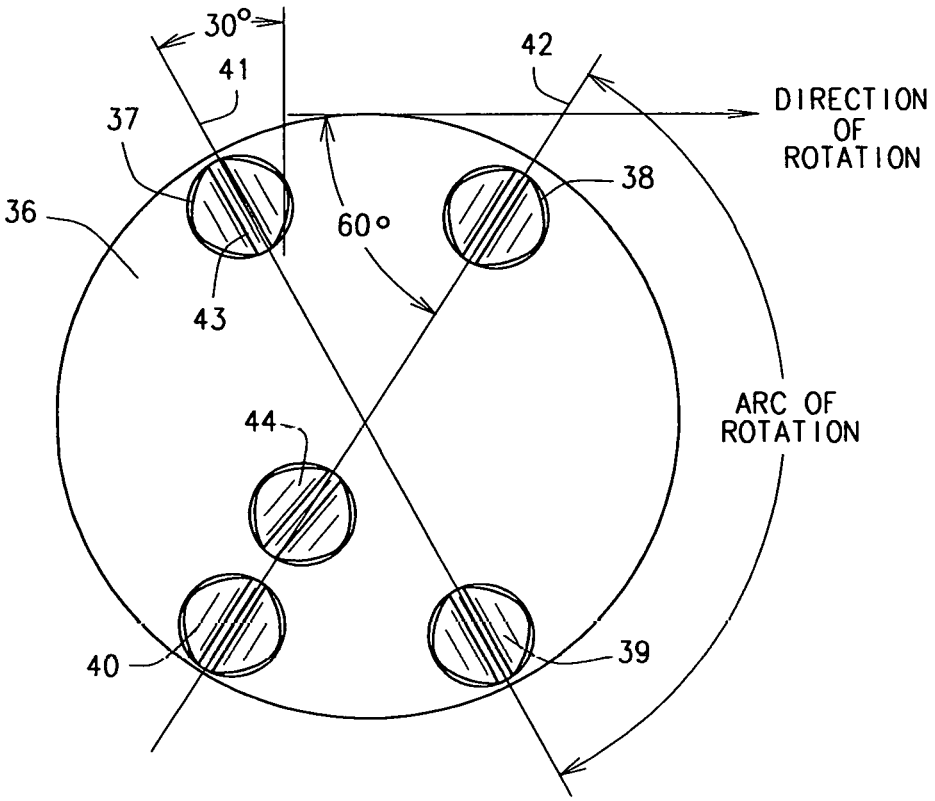
FIG. 3 provides a top view of a drill bit incorporating a plurality of PCD chisel inserts primarily arranged in the plowing mode, with a single skewed insert provided for functioning in a slicing mode during percussion drilling.

An example of the application of the chisel form of PCD inserts to the drill bits, can be noted in FIG. 3. This is an example of an array of chisel type inserts applied to the frontal surface 36 of the shown drill bit. As noted, a series of the inserts that locate along the outer perimeter of the drill bit can be seen at 37 through 40. As noted, these particular inserts are arranged at approximately a perpendicular angle to the arc of rotation of the bit, and pairs of them, as 37 and 39, and 38 and 40, are arranged linearly, as noted at 41 and 42, and the inserts are arranged in a plowing mode, rather than slicing mode, when used in a drilling operation. The plowing mode means that the upper transverse edge, one as shown at 43, is arranged 90° from the direction of rotation of the drill bit, during its application and usage. Thus, the edge of the insert does not slice the hardened ground, but rather, impacts it due to the percussion drilling, and then simply plows the debris forwardly, in order to achieve further cutting of the rock, in its pushing forwardly, during the rotation of the drill bit. It has been found that the PCD chisel insert, when they angled at about a 30° angle, apart from the vertical, as noted, or approximately at that perpendicular angle with respect to the arc of rotation, and thus are further arranged approximately 60° apart from each other, as noted, from the direction of rotation.

As can further be noted, an additional PCD chisel insert 44 is provided, and it is arranged at an angle of approximately 15°, from the perpendicular, in order to reduce the torque pressure on the insert and have the insert cutting action in a slicing type of mode, for drilling.

Figure 4A:
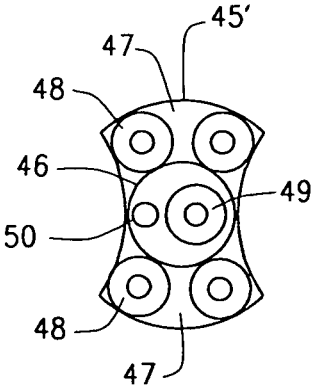
FIG. 4A shows a percussion drill bit incorporating a series of PCD conical inserts.

FIG. 4A shows another embodiment for a PCD drill bit 45, in this particular instance, being 5 inserts located strategically around the surface of the bit, both on its frontal flat face 46, and its beveled peripheral edges, as at 47, and includes the PCD conical type of insert design, as noted at 48. There is an additional conical insert 49 provided upon the frontal flat face of the drill bit, while the remaining conical inserts locate upon its beveled edges. There is also at least one fluid flush hole 50 through which a cleansing fluid, such as water under pressure, discharges into the vicinity of the face of the drill bit 45, during a percussion drilling operation, in order to remove the fractured debris, in the manner as previously explained.

It might be summarized, once again, at this time, that the various types of PCD conical inserts provided within the frontal face of the drill bit, in practical application, may have the following range of dimensions, in their structure.

Insert Parameters for PCD Conical and Chisel Type Percussion Drill Bit Applications

| | |
|---|---|
| PCD Insert Diameter range | .300" to .750" |
| PCD Insert grip length | .300" to .600" |
| PCD Insert tip length | .250" to .360" |
| PCD Tip radius Range Conical Inserts | .125" to .170" |
| PCD Tip radius Range Chisel Inserts | .04" to .135" |
| PCD tip length in a range of | .225" to .375" |
| PCD Coating thickness on Tip of Inserts | .010" to .060" |

Figure 4B:
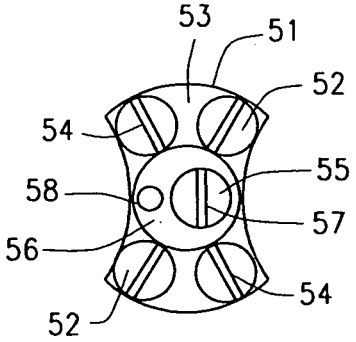
FIG. 4B shows a top view of a percussion drill bit incorporating a series of PCD chisel type inserts.

FIG. 4B shows a related type of percussion drill bit 51, but in this particular instance, it contains a plurality of the chisel type PCD inserts, as noted at 52. These inserts are generally arranged and provided along the outer beveled surface 53, and generally are set in the plowing mode, since the angle of their upper cutting edges, as at 54, are generally arranged at the perpendicular to the arc of rotation of the drill bit, during usage, and are further arranged in alignment with the radius from the center of the drill bit, as can be noted. There is a further chisel PCD insert 55 that is provided within the upper flattened face 56 of the drill bit, and this particular insert, and its upper transverse cutting edge 57 will be arranged at various angles with respect to the perpendicular to the arc of rotation of the bit, in order to place this particular insert into a plowing mode. Hence, it has been found desirable to arrange this particular insert, at an angular disposition with respect to said perpendicular, between about 0°, which would be in a plowing mode, and up to approximately 45°, which would furnish the ultimate slicing mode for this particular insert, when applied within the percussion drill bit, during a drilling operation. The aperture 58, once again, is provided for delivering cleansing fluid such as water under pressure, to the face of the drill bit, during a percussion drilling operation. The outer beveled surface 53 of the shown percussion drill bit is identified as the reamer portion of the drill bit.

Figure 4C:
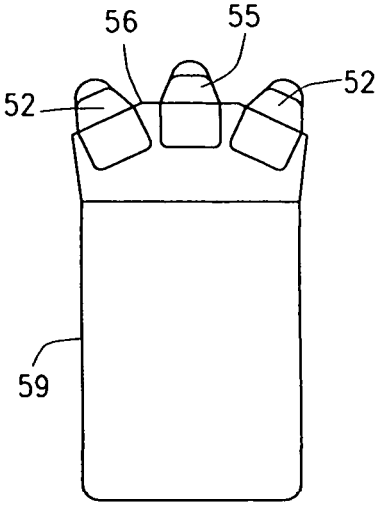
FIG. 4C provides a side view of the percussion drill bit disclosed in FIG. 4B.

FIG. 4C shows a side view of the chisel PCD inserts, such as 52, provided within the beveled outer surface of the drill bit, and the insert 55 that is provided extending from the frontal flat face 56, of the shown bit body 59.

Figure 4D:
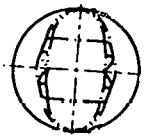
FIG. 4D provides a top view of a chisel type insert wherein its upper chisel surface is of a oval like configuration, to add strength to its cutting edges.

FIG. 4D shows a top view of a chisel insert wherein its upper cutting edge is of a somewhat oval like configuration, in order to add strength to the cutting surface of the shown modified chisel insert.

It might be stated at this time that the usage of the various inserts in the drill bits, such as shown in FIG. 4A, and subsequently in FIGS. 5 and 6, all have select either conical or chisel type of inserts provided upon the frontal flat face of the shown drill bits. And, there are also either conical or chisel inserts that are provided upon the outer beveled surfaces of the front face of the drill bits, as can be noted. In effect, when these types of bits, with their shown inserts, are applied, at these angular installations, those inserts provided upon the upper flat face of the bit function in a drilling action to initiate the cutting of the pilot hole at the center of the drilled hole, and then the outer inserts applied to the beveled surfaces of the bits function to ream the rock, into a refined drilled hole, during usage of these PCD percussion drill bits. It is believed this occurs because the inserts in the frontal flat face of the drill bits are actually higher or extend further upwardly from the inserts provided upon the beveled faces, and therefore, one does function a means for drilling the pilot hole, while the outer gauge inserts function for reaming the rock to the piloted center cut.

Figure 5:
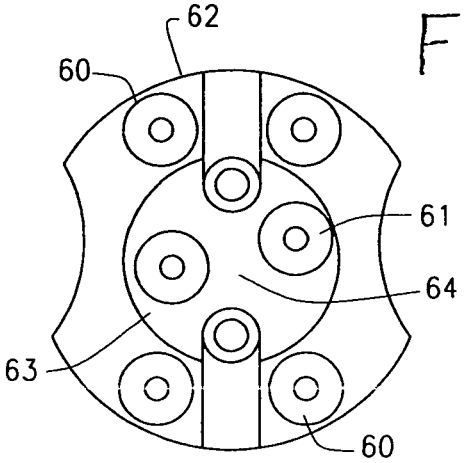
FIG. 5 provided a top view of a percussion drill bit having a frontal flat face and an integral beveled face incorporating a series of the PCD conical type inserts.

FIG. 5 show the application of a series of PCD conical inserts 60 and 61 applied to the beveled portion 62 of the drill bit, and also to the frontal flat face 63, respectively. It is to be noted that the conical inserts generally have slightly different dimensions from the center point 64 of the shown bit, in order to lesson tracking of the cutting achieved by the various inserts, during a percussion drilling operation.

Figure 6:
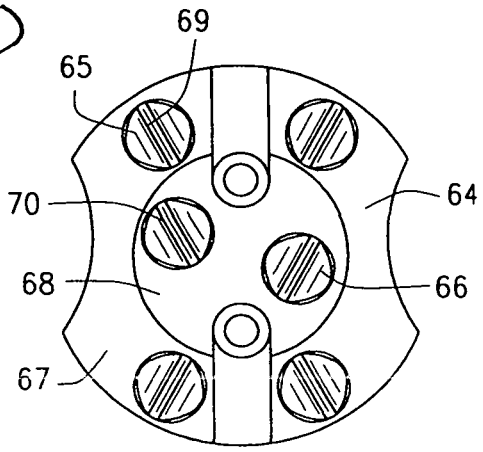
FIG. 6 is a top view of a percussion drill bit incorporating a series of the PCD chisel type inserts, select of most of said inserts being incorporated within the bit and arranged in a slicing mode.

FIG. 6 provides a top view of the percussion drill bit 64 having a series of PCD chisel inserts 65 and 66 provided, respectively, upon the outer beveled surface 67 and the frontal flat face 68 of the shown drill bit, as previously reviewed. As can be noted, the transverse upper cutting edges, as at 69, are slightly angulated, at a small degree, off of the perpendicular from the arc of rotation of the drill bit, in order to initiate the functioning of the insert into a slight slicing mode, particular with respect to those inserts 65 provided upon the outer beveled surface. But, the transverse upper cutting edges 70 of those inserts applied to the frontal flat face 68 of the bit are arranged at much greater angles, approximately 30°, as shown, in order to provide full slicing through the application of the bit when impacting upon the hardened earth, during performance of a percussion drilling operation.

Figure 7:
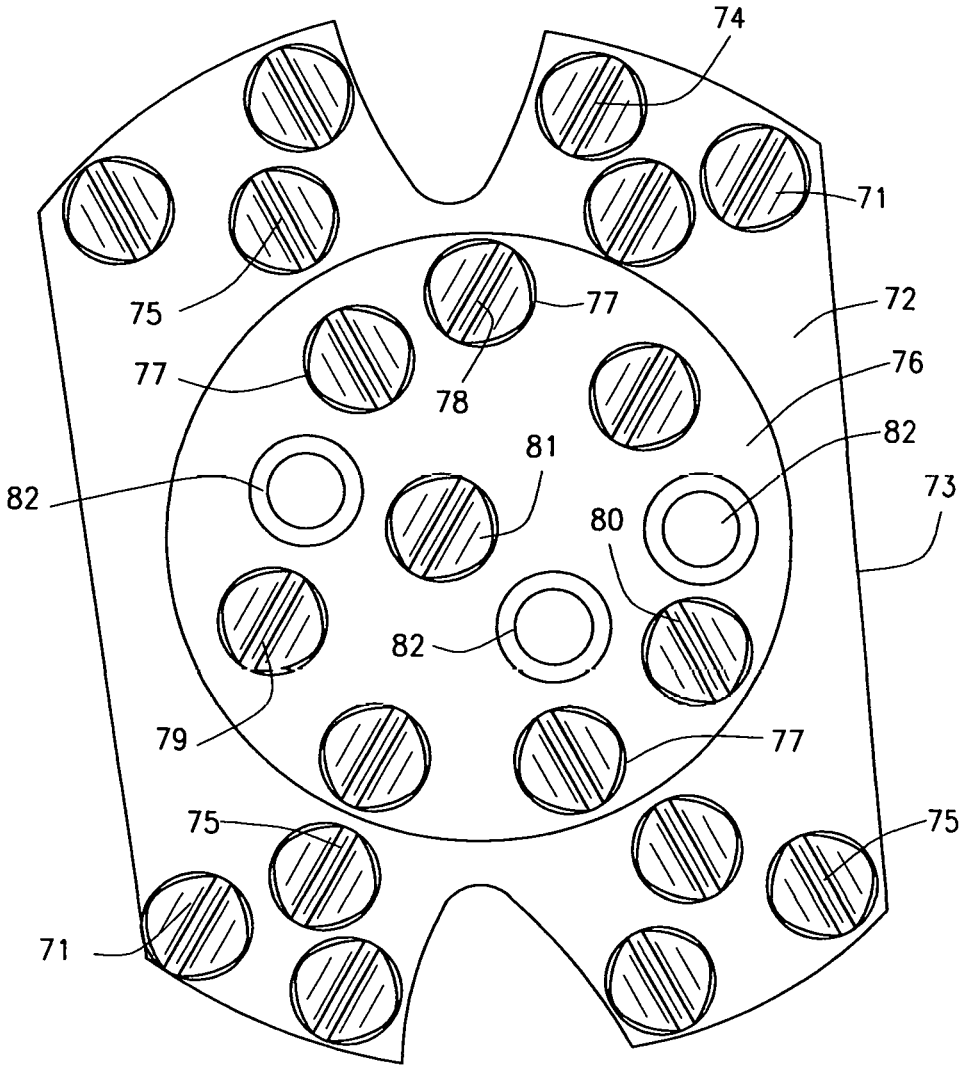
FIG. 7 is a top plan view of a percussion drill bit having a frontal flat face and an integral beveled face extending outwardly therefrom, and incorporating a series of PCD chisel inserts primarily arranged for providing the slicing mode for percussion drilling.

FIG. 7 shows the usage of a plurality of the PCD chisel type inserts, as at 71, applied to the outer beveled surface 72 of the drill bit 73. And, most of these inserts, and more specifically their upper transverse cutting edges 74, are arranged in a slicing mode, being offset a few degrees from the perpendicular to the arc of rotation of the drill bit, during its usage. As can be seen, most of these upper edges, as noted at 75, are arranged a few degrees, approximately 10°, off of the perpendicular to the arc of rotation of the bit, during usage. In this manner, these inserts function in a slight slicing mode when impacting the hardened earth during a percussion drilling operation. This is so even when the bit, of a larger size, may be used in the percussion rotary drilling of an oil well. They push the debris outwardly of the shown bit. As can also be seen, for the flat frontal face 76 for the drill bit, the PCD chisel type inserts 77, are located within the bit body, at various locations, and at more significant angles from the perpendicular to the arc of rotation, of the drill bit, when used. For example, it can be seen that the transverse upper cutting edge 78 for one of the inserts 77 is at an approximate 30° angle from the perpendicular to the arc of rotation, as are the transverse cutting edges 79 and 80 for the shown inserts, which are clearly deployed in the surface of the drill bit in the slicing mode of usage. And, as can be noted, there are just no vertical planes of symmetry that pass through the central axis of the bit body, with respect to each of these applied PCD chisel type inserts, particularly those that are arranged within the frontal flat face 76, of the shown drill bit. Furthermore, as can be noted, many of the inserts 77 installed within the flat face 76 of the drill bit are at a different radii from the center 81 of the bit body, and therefore, avoids tracking of any of these inserts relative to the other during performance of a percussion drilling operation. In other words, many of the inserts do their own slicing of the ground, independently of the other inserts, in order to greatly enhance the efficiency of the drilling operation, when performed. In addition, in order to maximize flushing of any cuttings from the drilled earth, there are a series of apertures 82 for delivering water under pressure to the front surface of the drill bit, during a percussion drilling operation. The outer beveled surface 72 of the shown drill bit is identified as the reamer portion of the percussion drill bit.

Figure 8:
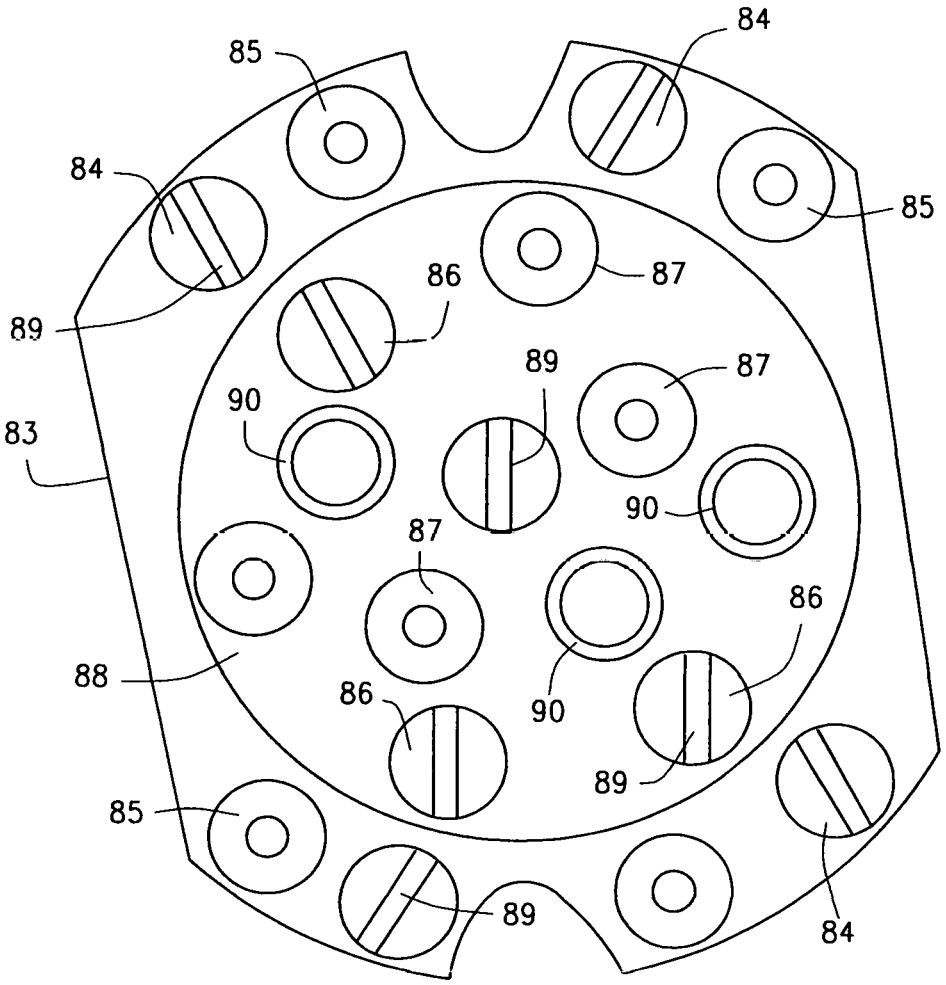
FIG. 8 provides a top view of a percussion drill bit having a frontal flat face and an integral beveled face extending outwardly therefrom, and incorporating a series of combinations of PCD chisel inserts and PCD conical type inserts in its design.
Figure 9:
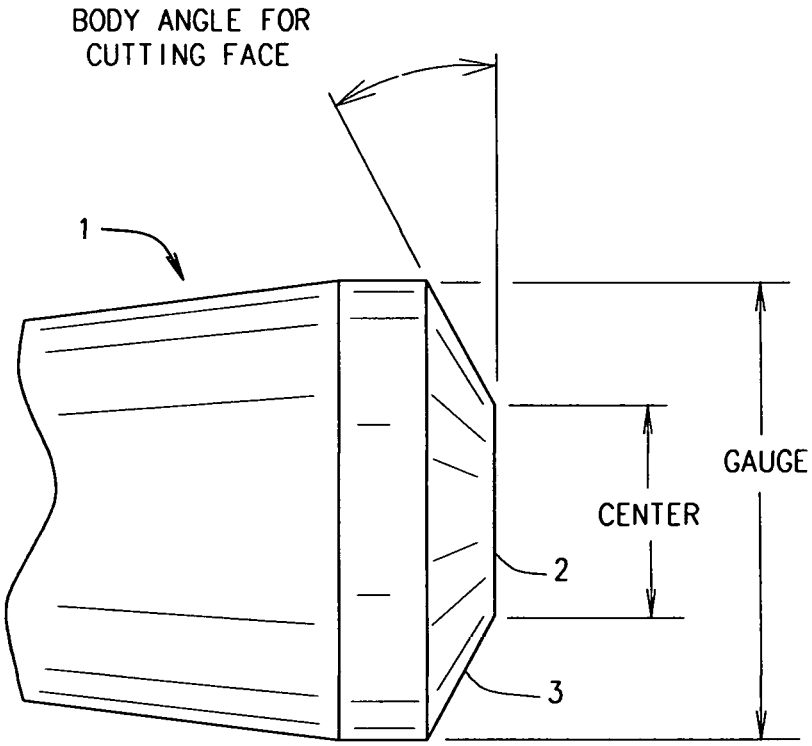
FIG. 9, as previously reviewed, is a partial side view of a bit body showing its various parameters.
Figure 10:
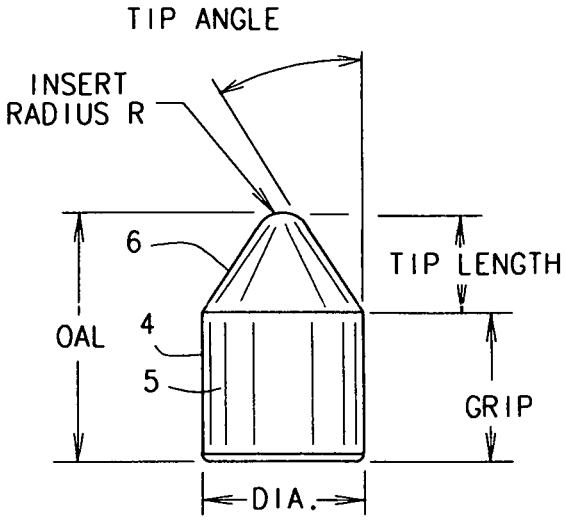
FIG. 10 provides a side view of an insert, of the polycrystalline diamond and conical design, for application to the front surface or cutting face of the bit body, as of FIGS. 5 and 8.
Figure 11:
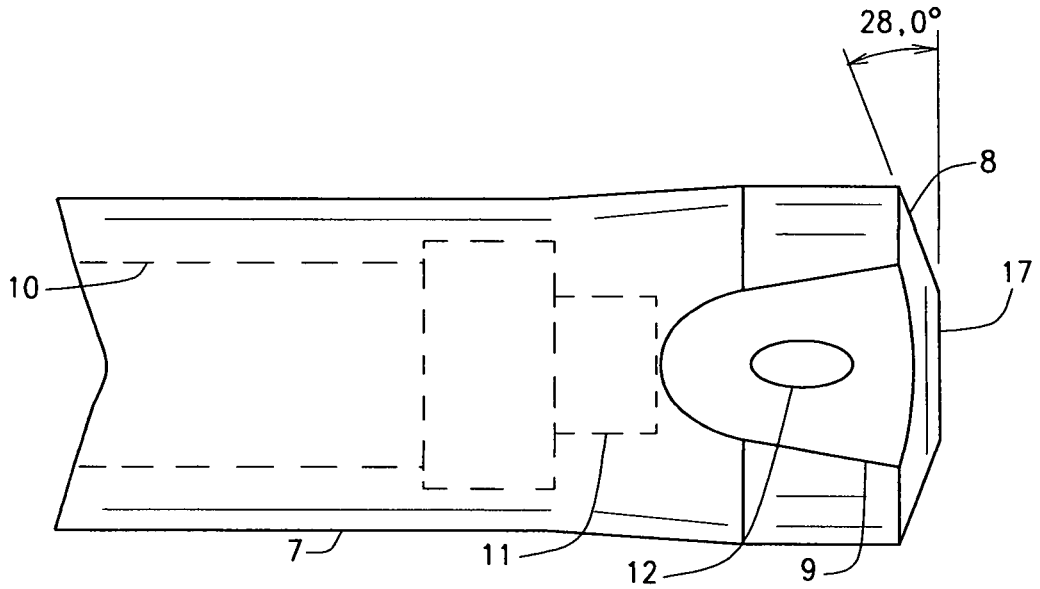
FIG. 11 shows a complete side view of a bit body disclosing its cutting face at one end, having both a frontal flat face and beveled face extending outwardly therefrom, and showing at least one of the discharged ports for the application of cleaning fluid, or water, used to flush out the drilled hole during percussion drilling.
Figure 12A:
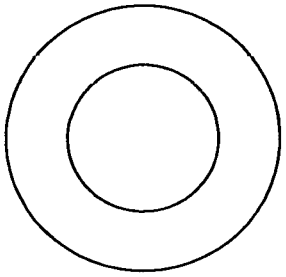
FIG. 12A provides a top view of a conical insert for a percussion drill bit.
Figure 12B:
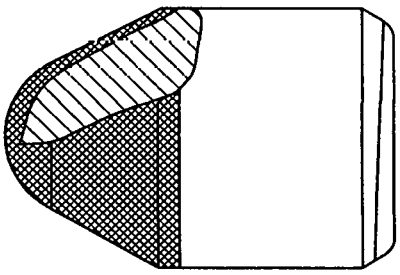
FIG. 12B shows a side view, partially cut away, of a conical insert having a polycrystalline diamond coating provided upon its upper surface.
Figure 13:
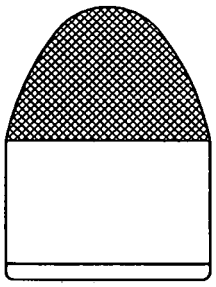
FIG. 13 shows a further side view, and the various dimensions, for the complete polycrystalline conical insert for a percussion drill bit, as used in this disclosure.

FIG. 8 discloses a percussion drill bit 83 where a combination of PCD chisel type inserts, as at 84, are used in combination with a series of PCD conical inserts 85, as can be noted. This type of drill bit, containing this many inserts, is generally structured in the four inch through eight inch percussion type, and down the hole hammer drill bit, such as 83, as noted. Any combination of the conical and chisel designed PCD inserts are employed, and it is believed that this is the first time that such a combination has been structured. A similar type of relationship of a combination of chisel type inserts 86, and a series of PCD conical type inserts 87 are also applied to the frontal flat face 88 of the shown drill bit. You should note that most if not all of the transverse cutting edges 89 are arranged in a slicing mode, generally between slightly more than 0°, and up to 45°, with respect to the perpendicular from the arc of rotation of the drill bit, when employed. This provides that slicing type of cutting of the harden earth, during usage of the percussion drill bit, when performing a drilling operation. You should also note that many of the various inserts, whether of the PCD chisel type, or the PCD conical type, are arranged at differing distances along the radii from the center of the drill bit, in order to, once again, avoid tracking of one bit in its cutting function from overlapping the operations of another insert, during percussion drilling. And, the water apertures 90 are provided for flushing of the debris during a drilling function. The asymmetrical design of the location of the various applied inserts, with respect to the center axis of the bit, is provided, in order to enhance the efficiency of the drilling operation. A drill bit, of this design, is designed to drill fast, and clear the hole of cuttings, than has heretofore been designed.

Figure 14:
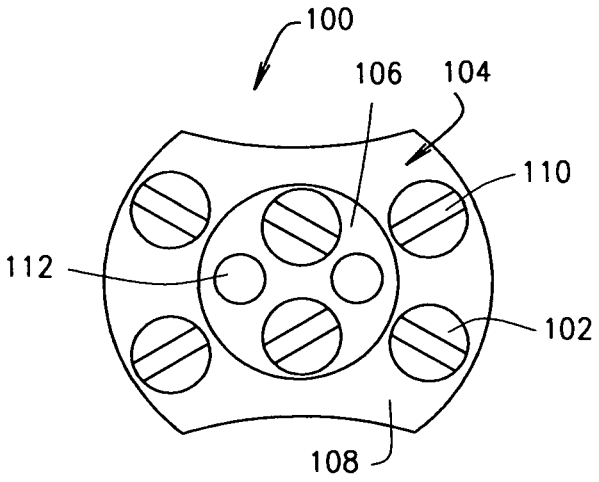
FIG. 14 is a top view of another embodiment of a percussion drill bit incorporating a series of PCD chisel inserts constructed according to the present disclosure.

FIG. 14 illustrates another embodiment for a PCD drill bit 100 constructed according to the present disclosure. The drill bit 100 comprises six inserts 102 located strategically around a surface 104 of the bit 100. Two of the inserts 102 are positioned on an inner frontal flat face 106 and four of the inserts 102 are positioned on an outer beveled peripheral surface 108. The inserts 102 that are generally arranged and provided along the outer beveled peripheral surface 108 are set in the plowing mode. These inserts 102 each have an upper cutting edge 110 having an angle that is arranged to be generally arranged at the perpendicular to the arc of rotation of the drill bit 100, during usage, and are further arranged in alignment with the radius from the center of the drill bit 100. The inserts 102 that are positioned within the inner frontal flat face 106 of the drill bit 100 will also be arranged at various angles with respect to the perpendicular to the arc of rotation of the bit 100, in order to place these particular inserts 102 into a plowing mode. The drill bit 100 also has a pair of apertures 112 provided on the inner frontal flat face 106. The apertures 112 are provided for delivering a quantity of cleansing fluid, such as water, under pressure, to the surface 104 of the drill bit 100, during a percussion drilling operation. This assists in removing fractured debris during a percussion drilling operation. By way of example only, some of the dimensions for the drill bit 100 may be that the outer beveled peripheral surface 108 is beveled at 28°. The inserts 102 may have a diameter of 0.4439". The apertures 112 may be ¼" or 3/16" in diameter. The insert grip length of the inserts 102 positioned on the outer beveled peripheral surface 108 may be 0.462" and the inserts 102 positioned on the inner frontal flat face 106 may have a length of 0.360".

Figure 15:
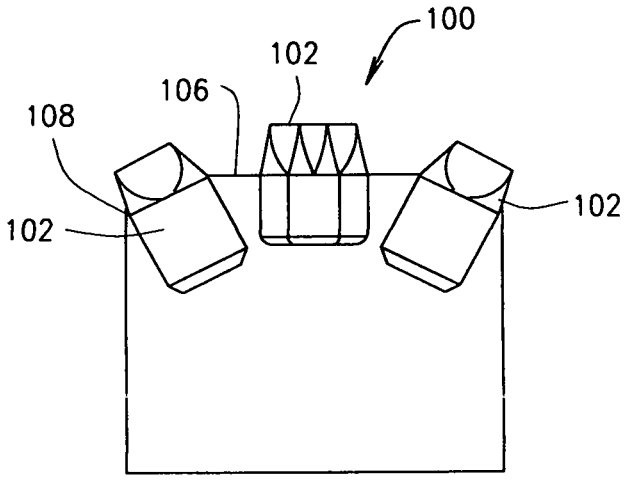
FIG. 15 is a front view of the percussion drill bit shown in FIG. 14.

Referring now to FIG. 15, a side view of the drill bit 100 is shown. The drill bit 100 has the inserts 102 positioned on the outer beveled peripheral surface 108 and the inserts 102 positioned on the inner frontal flat surface 106. The outer beveled peripheral surface 108 is beveled at 28° with respect to the inner frontal flat surface 106.

Figure 16:
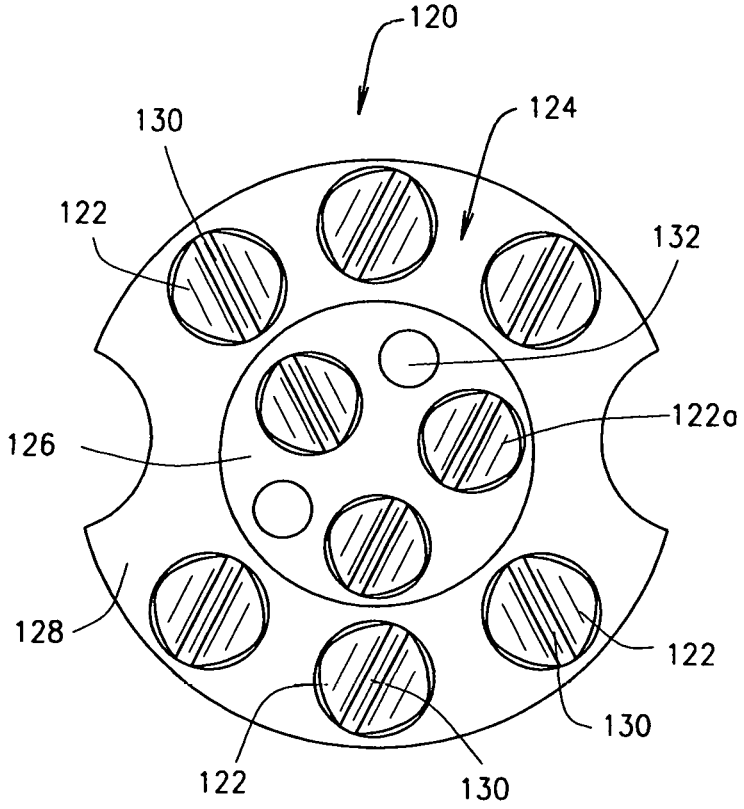
FIG. 16 is a top view of another embodiment of a percussion drill bit incorporating a series of PCD chisel inserts constructed according to the present disclosure.

FIG. 16 depicts another embodiment of a very preferred PCD drill bit 120 constructed according to the present disclosure. The drill bit 120 comprises nine inserts 122 located strategically around a surface 124 of the bit 120. Three of the inserts 122 are positioned on an inner frontal flat face 126 and six of the inserts 122 are positioned on an outer beveled peripheral surface 128. The inserts 122 that are generally arranged and provided along the outer beveled peripheral surface 128 are set in the plowing mode. These inserts 122 each have an upper cutting edge 130 that are positioned at various angles. The inserts 122 that are positioned within the inner frontal flat face 126 of the drill bit 120 are also arranged at various angles with respect to the perpendicular to the arc of rotation of the bit 120, in order to place these particular inserts 122 into a slicing mode. The drill bit 120 also has a pair of apertures 132 provided on the inner frontal flat face 126. The apertures 132 are provided for delivering a quantity of cleansing fluid, such as water, under pressure, to the surface 124 of the drill bit 120, during a percussion drilling operation. This assists in removing fractured debris during a percussion drilling operation. By way of example only, some of the dimensions for the drill bit 120 may be that the outer beveled peripheral surface 128 is beveled at an angle of 28° relative to the inner frontal flat face 126. The six inserts 122 may have a diameter of 0.625". These inserts 122 may be positioned with four of the inserts 122 being set at 45° and the other two inserts 122 being rotated by 30° to the left or right, as shown. The three inserts 122 provided on the inner frontal flat face 126 may have a diameter of 0.565". These inserts 122 are all vertical but are asymmetrically placed. The apertures 132 may be 3/16" in diameter. The size of these PCD bits may be in a range of 2½" to 30", and their chisel inserts may have three to five layers of diamond coating, to provide the maximum thickness for usage of these types of inserts in percussion drilling.

Figure 17:
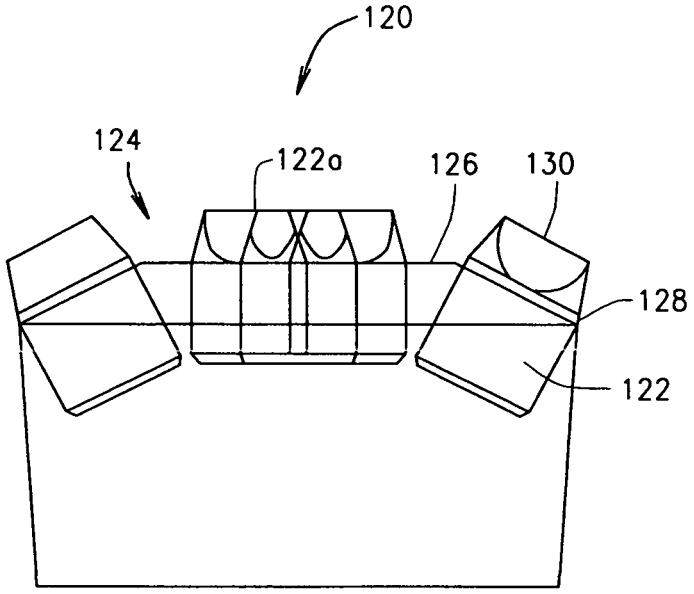
FIG. 17 is a front view of the percussion drill bit shown in FIG. 16.

With reference now to FIG. 17, a side view of the drill bit 120 is shown. The drill bit 120 has the chisel type PCD inserts 122 positioned on the outer beveled peripheral surface 128 and the inserts 122 positioned on the inner frontal flat surface 126. The outer beveled peripheral surface 128 is beveled at 28° with respect to the inner frontal flat surface 126. The inserts 122*a* associated with the inner frontal flat surface 126 are positioned asymmetrically about the surface 126. As has been indicated, the diameter of each of the inserts 122 positioned about the outer beveled peripheral surface 128 is larger than the diameter of each of the inserts 122*a* positioned about the inner frontal flat surface 126.

Figure 18:
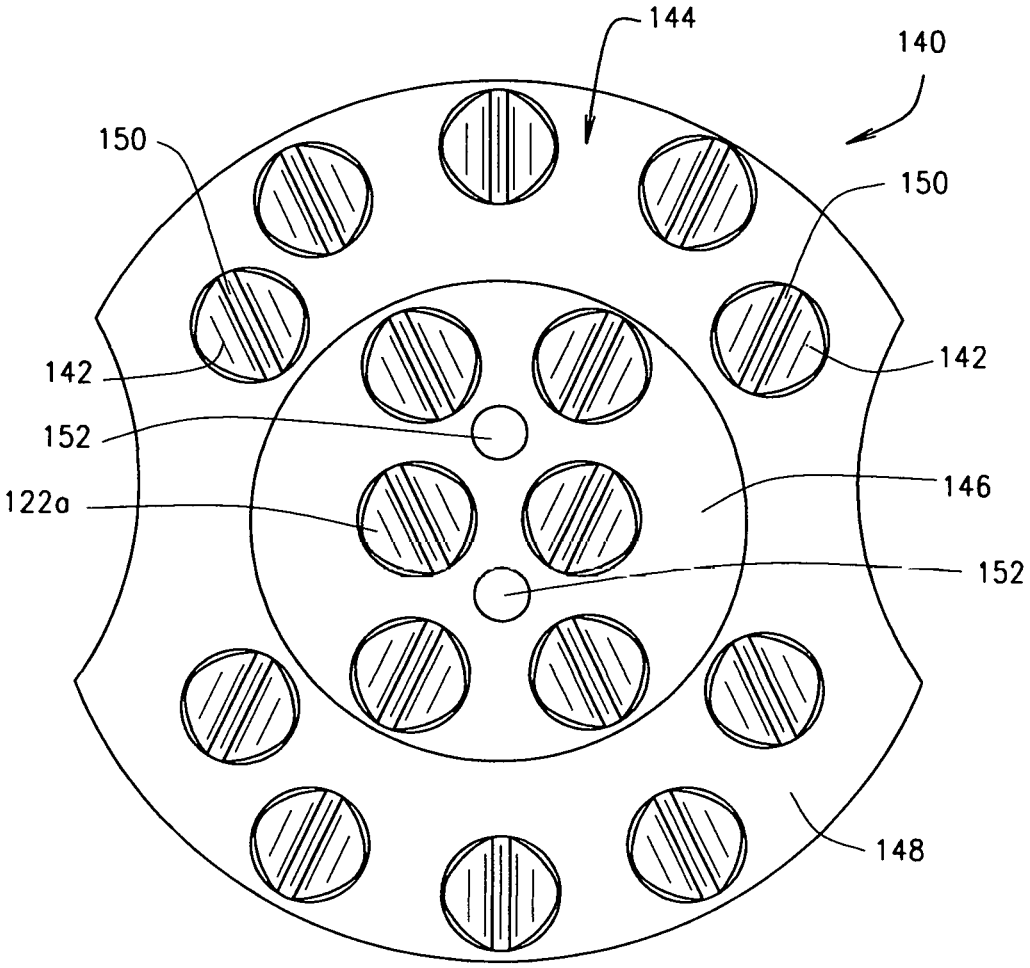
FIG. 18 is a top view of another embodiment of a percussion drill bit incorporating a series of PCD chisel inserts constructed according to the present disclosure.

FIG. 18 illustrates another embodiment of a PCD drill bit 140 constructed according to the present disclosure. The drill bit 140 comprises sixteen chisel inserts 142 located strategically around a surface 144 of the bit 140. Six of the inserts 142*a* are positioned on an inner frontal flat face 146 and ten of the inserts 142 are positioned on an outer beveled peripheral surface 148. The inserts 142 that are generally arranged and provided along the outer beveled peripheral surface 148 may be set in the plowing mode. These inserts 142 each have an upper cutting edge 150 that are positioned at various angles. These inserts 142 positioned on the surface 148 are also extended 0.050" above the surface 148. For example, these inserts 142 may have an insert grip length of 0.462" and 0.050" of the insert grip length will extend above the surface 148. The inserts 142*a* that are positioned within the inner frontal flat face 146 of the drill bit 140 are also arranged at various angles with respect to the perpendicular to the arc of rotation of the bit 140, in order to place these particular inserts 142*a* into a plowing mode. The drill bit 140 also has a pair of apertures 152 provided on the inner frontal flat face 146. The apertures 152 are provided for delivering a quantity of cleansing fluid, such as water, under pressure, to the surface 144 of the drill bit 140, during a percussion drilling operation. This assists in removing fractured debris during a percussion drilling operation. By way of example only, some of the dimensions for the drill bit 140 may be that the outer beveled peripheral surface 148 is beveled at an angle of 30° relative to the inner frontal flat face 146. The inserts 142 may have a diameter of 0.625". However, it is also contemplated that the inserts 142*a* positioned about the inner surface 146 may instead having a diameter of 0.565". The apertures 152 may be 0.375" in diameter.

Figure 19:
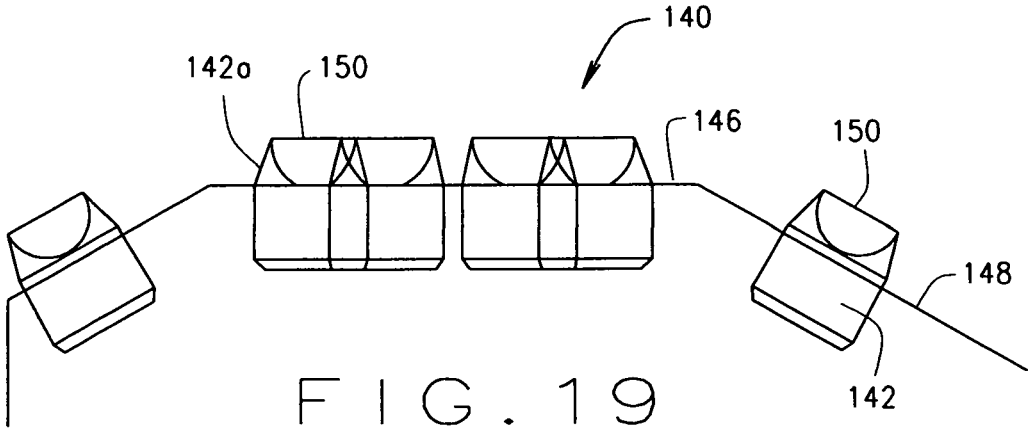
FIG. 19 is a front view of the percussion drill bit shown in FIG. 18.

With particular reference now to FIG. 19, a side view of the drill bit 140 is shown. The drill bit 140 has the inserts 142 positioned on the outer beveled peripheral surface 148 and the inserts 142*a* positioned on the inner frontal flat surface 146. The outer beveled peripheral surface 148 is beveled at about 28°-30° with respect to the inner frontal flat surface 146. As has been indicated, the diameter of each of the inserts 142 may be 0.625", but the diameter of the inserts 142*a* positioned along the surface 146 may also be 0.565".

Figure 20:
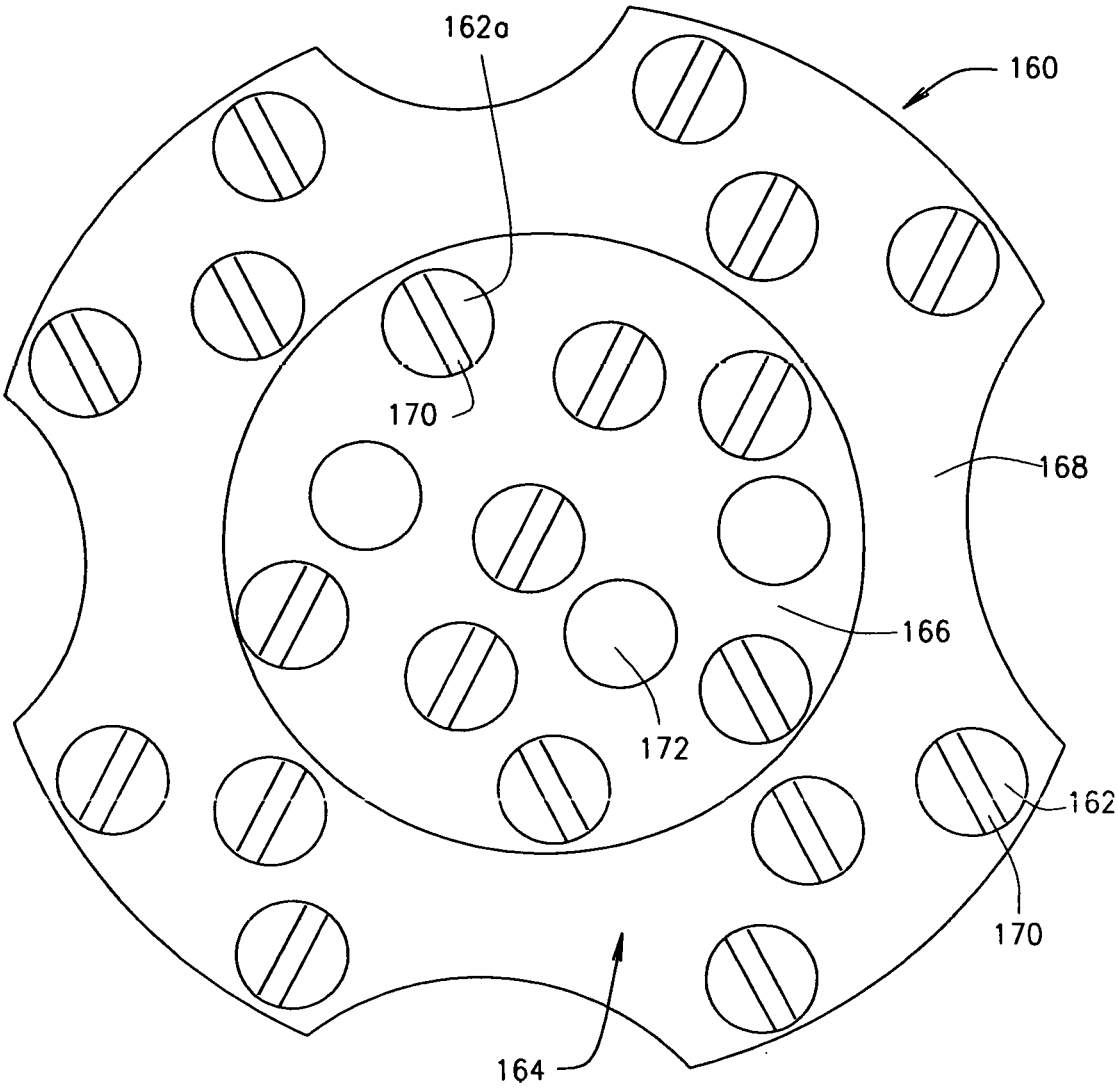
FIG. 20 is a top view of another embodiment of a percussion drill bit incorporating a series of PCD chisel inserts constructed according to the present disclosure.

FIG. 20 shows another embodiment of a PCD drill bit 160 constructed according to the present disclosure. The drill bit 160 comprises twenty inserts 162 and 162*a* located strategically around a surface 164 of the bit 160. Eight of the inserts 162*a* are positioned on an inner frontal flat face 166 and twelve of the inserts 162 are positioned on an outer beveled peripheral surface 168. The inserts 162 that are generally arranged and provided along the outer beveled peripheral surface 168 are set some in the plowing mode and some in the slicing mode. These inserts 162 and 162*a* each have an upper cutting edge 170 that are positioned at various angles. The inserts 162*a* that are positioned within the inner frontal flat face 166 of the drill bit 160 are also arranged at various angles with respect to the perpendicular to the arc of rotation of the bit 160, in order to place some of these particular inserts 162*a* into a plowing mode. The drill bit 160 also has three apertures 172 provided on the inner frontal flat face 166. The apertures 172 are provided for delivering a quantity of cleansing fluid, such as water, under pressure, to the surface 164 of the drill bit 160, during a percussion drilling operation. By way of example only, some of the dimensions for the drill bit 160 may be that the outer beveled peripheral surface 168 is beveled at an angle of 30° relative to the inner frontal flat face 166. The inserts 162 may have a diameter of 0.625". The apertures 152 may be 0.5022" in diameter.

Figure 21:
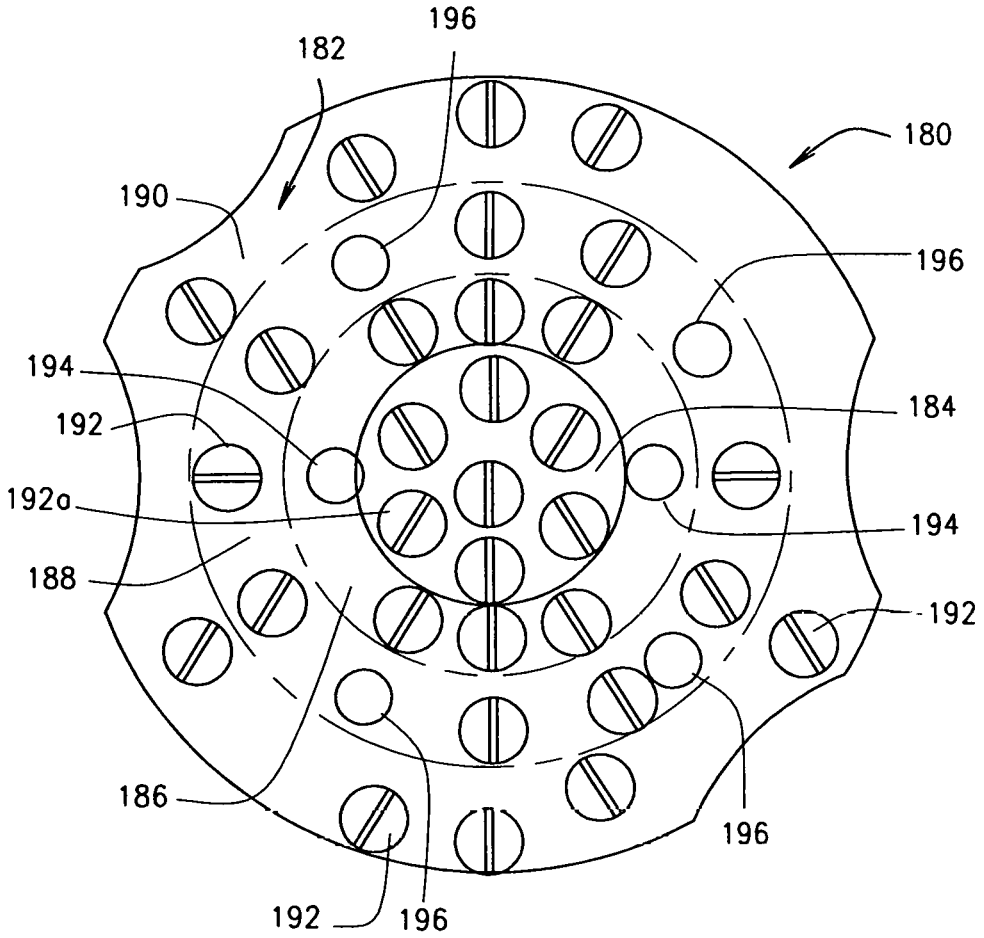
FIG. 21 is a top view of another embodiment of a percussion drill bit incorporating a series of PCD chisel inserts constructed according to the present disclosure.

Referring now to FIG. 21, another embodiment of a PCD drill bit 180 constructed according to the present disclosure. The drill bit 180 comprises a surface 182 having an inner frontal flat face 184, a first ring face portion 186 which is stepped down from the inner frontal flat face 184, a second ring face portion 188 which is stepped down from the first ring face portion 186, and an outer beveled ring face portion 190 which is sloped relative to the second ring face portion 188. The outer beveled ring face portion 190 is beveled or sloped at 28° with respect to the second ring face portion 188. By way of example only, the first ring face portion 186 may be stepped down from the inner frontal flat face 184 by ¼" and the second ring face portion 188 may be stepped down from the first ring face portion 186 by ¼". The drill bit 180 also has thirty-two inserts 192 located strategically around the surface 182. The inner frontal flat face 184 has seven inserts 192*a*, the first ring face portion 186 has six inserts 192, the second ring face portion 188 has nine inserts 192, and the outer beveled ring face portion 190 has ten inserts 192. The inserts 192 are 1" in diameter. The drill bit 180 also has two apertures 194 provided around the first ring face portion 186. The second ring face portion 188 has four apertures 196 spaced there around. As has been indicated, the apertures 194 and 196 are provided for delivering a quantity of cleansing fluid, such as water, under pressure, to the surface 182 of the drill bit 180, during a percussion drilling operation. By further way of example only, the surface 182 of the drill bit 180 may be 12¼" in diameter.

Figure 22:
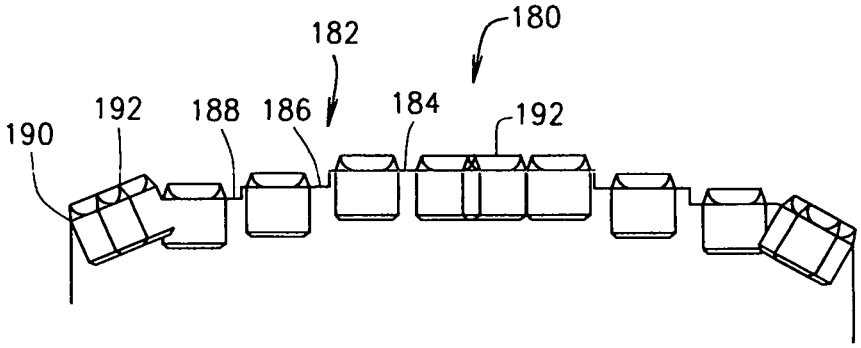
FIG. 22 is a front view of the percussion drill bit shown in FIG. 21.

FIG. 22 shows a side view of the drill bit 180. The drill bit 180 has the surface 182 having the inner frontal flat face 184, the stepped down first ring face portion 186, the stepped down second ring face portion 188, and the outer beveled ring face portion 190 which is sloped with respect to the second ring face portion 188. The outer beveled ring face portion 190 is beveled or sloped at 28° with respect to the second ring face portion 188.

It is to be noted that the various drill bits disclosed in these latter figures are of much larger size than the drill bits as earlier discussed within this application. These particular drill bits, which may have a diameter extending anywhere from 8" to 30", include a multitude of inserts that may have diameters between about 0.5"-1", and many of them are of the PCD chisel design. These chisel designed inserts are then located within their respective drill bits, either at a 90° angle relative to the arc of rotation of the drill bit, and function in that manner to plow the surface of the ground in which the bits are inserted, during a drilling operation. Or, select of the chisel type inserts may be located at an angular relationship with respect to the arc of rotation, and therefore, function in a slicing mode to cut the rock and ground in which the drill bits are located for penetrating during a drilling operation. With these larger type of drill bits, they can be used for percussion drilling when rotary drilling deep into the ground as when drilling for oil, as can be understood. And, these PCD type of chisel inserts, within their drill bits, are long lasting in usage, have high endurance, and are always operated in the vicinity of 8 to 20 Bar, for percussion drilling machine torque pressure, and between 12 to 28 Bar of drilling machine thrust pressure, during usage.

A chart showing the comparison between drilling with standard drill bits, incorporating the carbide type of bits, and the high thrust and torque encountered, but that when the chisel type PCD inserts are used in the drill bits, and arranged in predetermined plowing and slicing positions, substantially lower thrust and torque is encountered, to obtain highly effective drilling, and much longer life for the drill bits, when used.

In reviewing this conversion chart, the upper portion of the chart shows the type of psi encountered in rotary drilling in shale, sandstone, and limestone. You can see the psi encountered, and its conversion to Bar, and that these are far too high, and the use of even PCD type of inserts for that type of drilling will somewhat function, even though the Bar ranges are just exceedingly high. Once again, this is in rotary type drilling, not percussion drilling. When such inserts are used in percussion type drilling, at these high thrust and torque levels, the bits will shear, as previously reviewed. The type of percussion drilling required for high silica rock, may encounter ranges in the vicinity of 345 Bar, and this is still extremely high, and the drill bits, even with the PCD type of insets, will fail promptly, and shear. Percussion drilling is required in high compressive strength rock formations. The PCD conical or chisel type inserts make this drilling application more feasible, but it must be done at very low torque and thrust pressures.

On the other hand, percussion drill bits with PCD inserts, when employed in drill bits that may be in the range of 8" to 20" and when operated at low torque and thrust, when assembled and used in accordance with the current invention, exhibit a Bar range between 12 to 28, for machine torque, and a Bar range between 12 and 20, of machine thrust, during application. At these low torque and thrust ranges, the drill bits, in percussion drilling, and even for percussion rotary drilling, can drill far faster during usage, and the useful life of the bits is significantly extended, because they do not encounter the type of high psi that is encountered during previous carbide bit type of drilling, or rotary drilling, as known in the art. Percussion PCD drill bits, even those as designed as the chisel type defined herein, and when set in their specific angulation for either the plowing mode or the shearing mode for cutting of the rock, can drill in all rock formations, as noted in this chart. And, when undertaking such repetitive drilling, the bits are operated only at low thrust and low torque, during their usage for extended percussion drilling.

Figure 23:
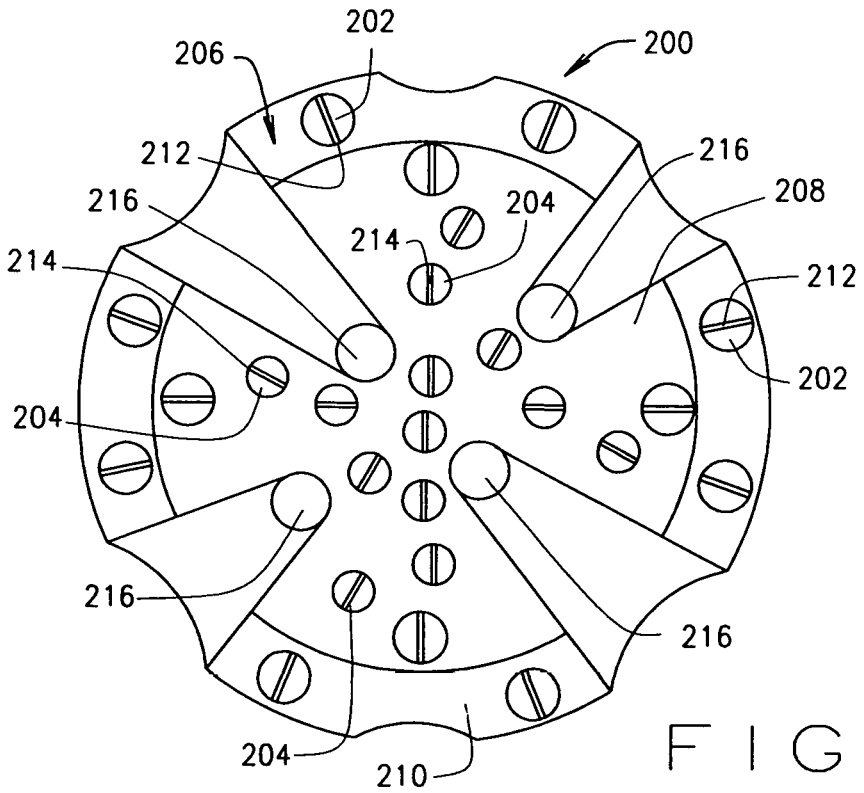
FIG. 23 is a top view of another embodiment of a percussion drill bit incorporating a series of PCD chisel inserts constructed according to the present disclosure.

Referring now in particular to FIG. 23, another embodiment of a PCD drill bit 200 constructed according to the present disclosure. The drill bit 200 comprises twelve inserts 202 having a first diameter and thirteen inserts 204 having a second diameter, with the first diameter being different than the second diameter, located strategically around a surface 206 of the bit 200. The drill bit 200 also has an inner flat face 208 and an outer beveled peripheral surface 210.

The outer beveled peripheral surface 210 is sloped or beveled with respect to the inner flat face 208 at an angle of 28°. The outer beveled peripheral surface 210 has eight of the inserts 202 spaced there around. The remaining four inserts 202 are positioned on the inner flat face 208. All thirteen of the inserts 204 are positioned about the inner flat face 208. Each of the inserts 202 have a cutting edge 212 and each of the inserts 204 also have a cutting edge 214. The cutting edges 212 and 214 are arranged at various angles. The drill bit 200 also has four apertures 216 that are used for providing a cleansing fluid. By way of example, the inserts 202 may have a diameter of 1" and the inserts 204 may have a diameter of 0.7". The drill bit 200 may also have a number of conical type inserts. Although a flat face 208 is shown it is also possible that the face 208 may be concave having the same pattern of inserts 202 and 204. Also, by placing larger apertures in the surface 206 the drill bit 200 may be made into a reverse circulation bit.

Figure 24:
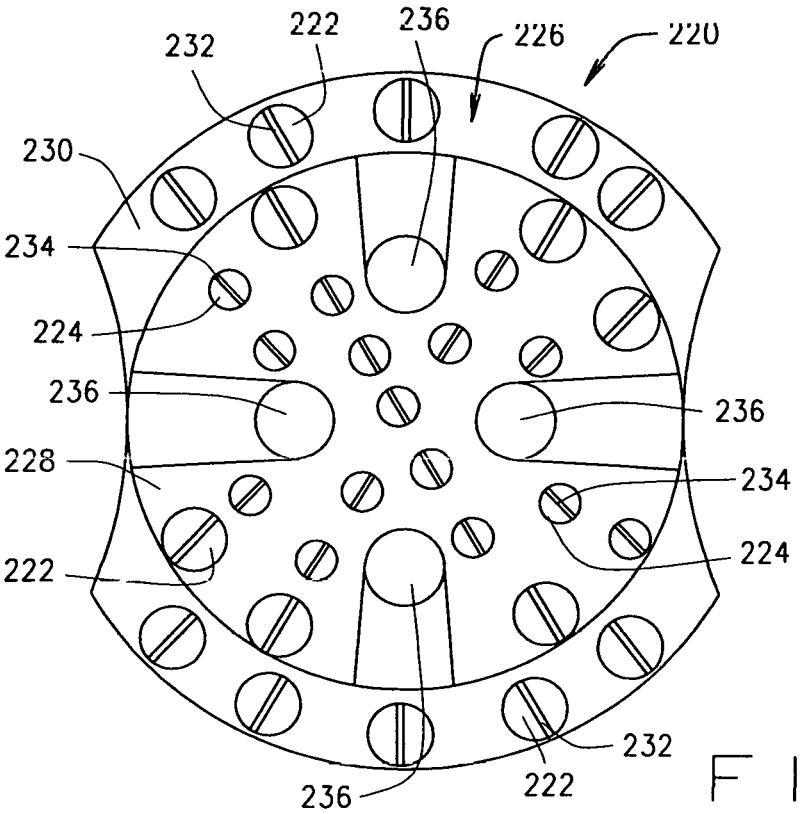
FIG. 24 is a top view of another embodiment of a percussion drill bit incorporating a series of PCD chisel inserts constructed according to the present disclosure.

FIG. 24 illustrates another embodiment of a PCD drill bit 220 constructed according to the present disclosure. The drill bit 220 comprises sixteen inserts 222 having a first diameter and fourteen inserts 224 having a second diameter, with the first diameter being different than the second diameter, located strategically around a surface 226 of the bit 220. The drill bit 220 also has an inner flat face 228 and an outer beveled peripheral surface 230. The outer beveled peripheral surface 230 is sloped or beveled with respect to the inner flat face 228. The outer beveled peripheral surface 230 has ten of the inserts 222 spaced there around. The remaining six inserts 222 are positioned on the inner flat face 228. All fourteen of the inserts 224 are positioned about the inner flat face 228. Each of the inserts 222 have a cutting edge 232 and each of the inserts 224 also have a cutting edge 234. The cutting edges 232 and 234 are arranged at various angles. The drill bit 220 also has four apertures 236 that are used for providing a cleansing fluid. By way of example, the inserts 222 may have a diameter of 1" and the inserts 224 may have a diameter of 0.7".

Figure 25:
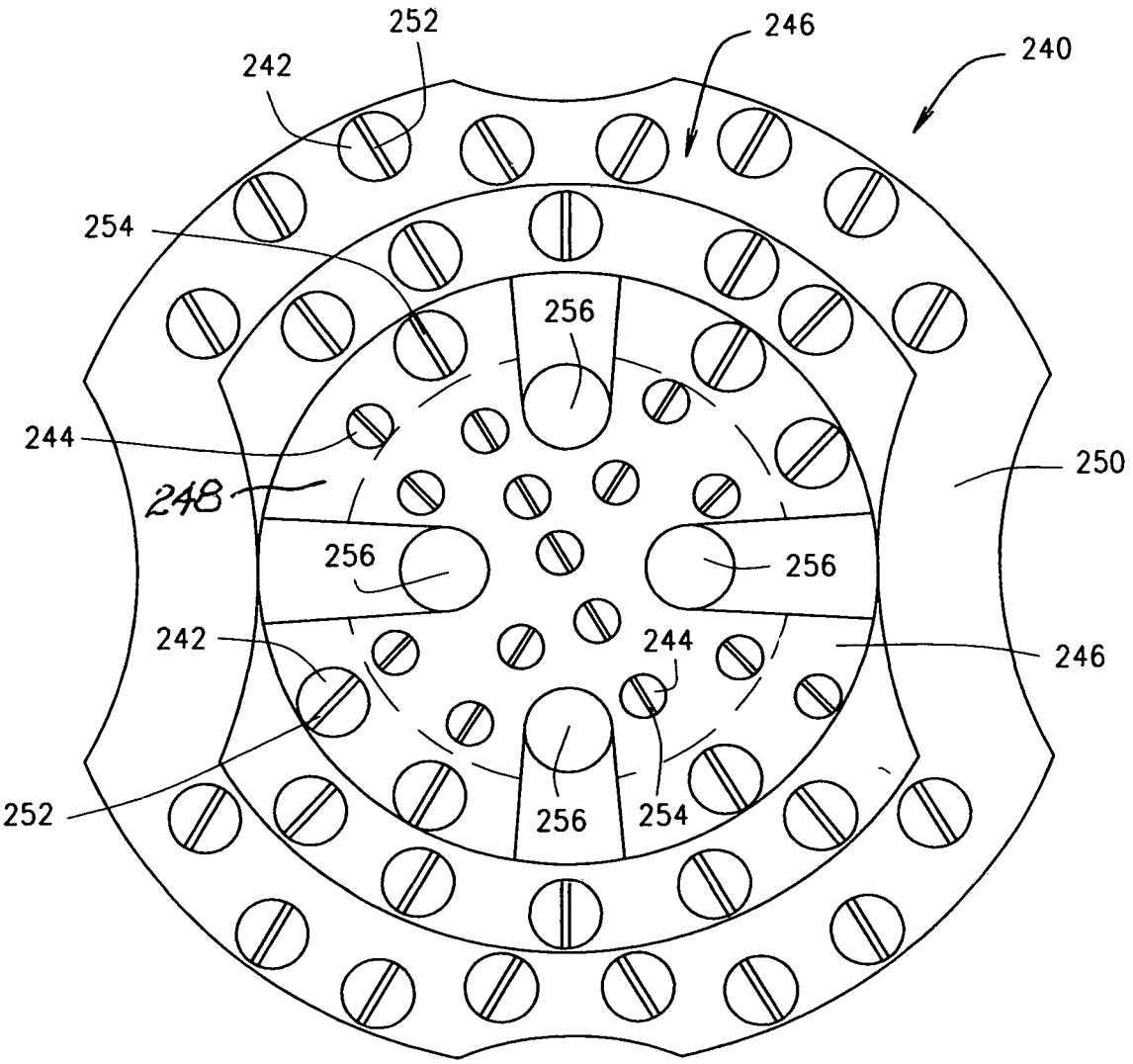
FIG. 25 is a top view of another embodiment of a percussion drill bit incorporating a series of PCD chisel inserts constructed according to the present disclosure.

With reference now to FIG. 25, another embodiment of a PCD drill bit 240 constructed according to the present disclosure is shown. The drill bit 240 comprises thirty-two inserts 242 having a first diameter and fifteen inserts 244 having a second diameter, with the first diameter being different than the second diameter, located strategically around a surface 246 of the bit 240. The drill bit 240 also has an inner flat face 248 and an outer beveled peripheral surface 250. The outer beveled peripheral surface 250 is sloped or beveled with respect to the inner flat face 248 at an angle of 28°. The outer beveled peripheral surface 250 has sixteen of the inserts 242 spaced there around. The remaining sixteen inserts 242 are positioned on the inner flat face 248. All fifteen of the inserts 244 are positioned about the inner flat face 248. Each of the inserts 242 have a cutting edge 252 and each of the inserts 244 also have a cutting edge 254. The cutting edges 252 and 254 are arranged at various angles.

The drill bit 240 also has four apertures 256 that are used for providing a cleansing fluid. By way of example, the inserts 242 may have a diameter of 1" and the inserts 244 may have a diameter of 0.7". The drill bit 240 may be produced in various sizes. For example, the drill bit 240 may have a diameter of 16" with the outer beveled peripheral surface 250 being 2". Also, the drill bit 240 may have a diameter of 12" and with the outer beveled peripheral surface 250 being 1¼".

Figure 26:
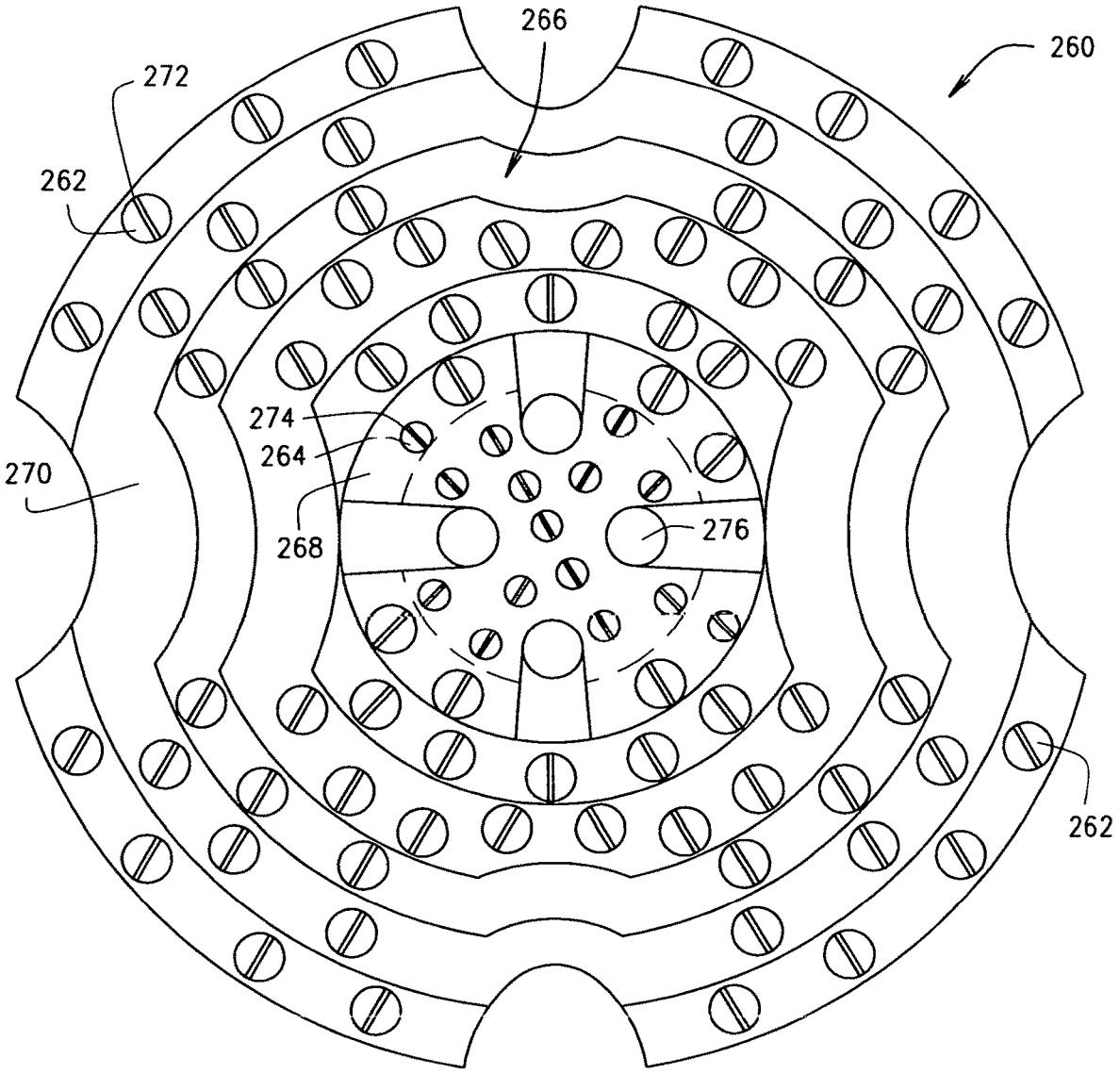
FIG. 26 is a top view of another embodiment of a percussion drill bit incorporating a series of PCD chisel inserts constructed according to the present disclosure.

FIG. 26 is another embodiment of a a PCD drill bit 260 constructed according to the present disclosure is shown. The drill bit 260 comprises seventy-one inserts 262 having a first diameter and sixteen inserts 264 having a second diameter, with the first diameter being different than the second diameter, located strategically around a surface 266 of the bit 260. The drill bit 260 also has an inner flat face 268 and an outer beveled peripheral surface 270. The outer beveled peripheral surface 270 is sloped or beveled with respect to the inner flat face 268 at an angle of 28°. The outer beveled peripheral surface 270 has sixteen of the inserts 262 spaced there around. The remaining inserts 262 are positioned on the inner flat face 268. All sixteen of the inserts 264 are positioned about the inner flat face 268. Each of the inserts 262 have a cutting edge 272 and each of the inserts 264 also have a cutting edge 274. The cutting edges 272 and 274 are arranged at various angles to undertake a slicing or plowing mode of operation. The drill bit 260 also has four apertures 276 that are used for providing a cleansing fluid. By way of example, the inserts 262 may have a diameter of 1" and the inserts 264 may have a diameter of 0.7". The inserts 262 and 264 form a modified letter X design. The drill bit 260 may also consist of a combination of PCD chisel inserts and conical type inserts. The PCD inserts may range from 0.625" to 1.032" in diameter. Further, by way of example only, the drill bit 260 may have various diameters such as 30", 24", 18", 16" or 12" to be used to drill large diameter holes.

Figure 27:
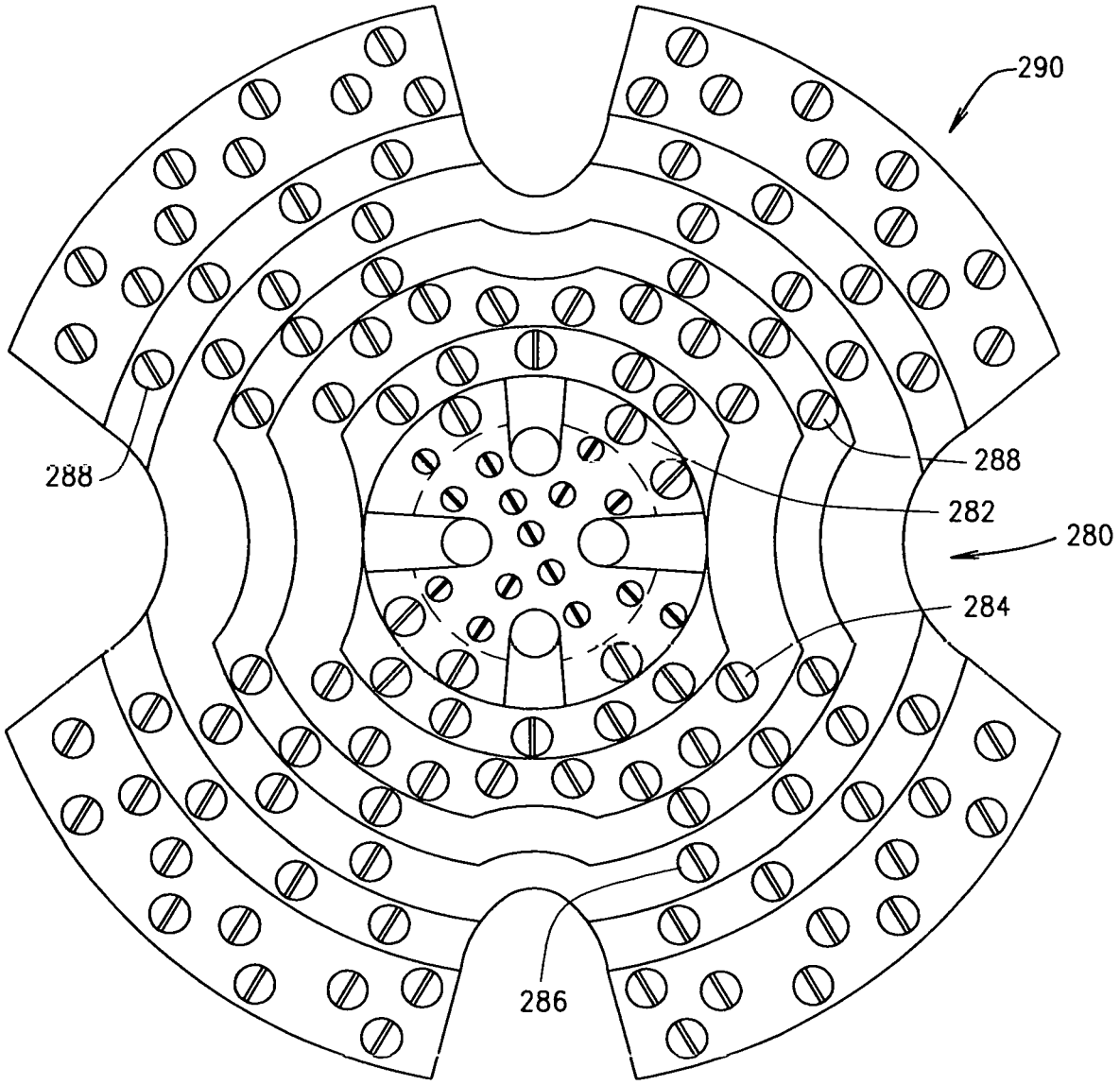
FIG. 27 is a top view of another embodiment of a percussion drill bit incorporating a series of PCD chisel inserts constructed according to the present invention.

FIG. 27 show the layout for a PCD chisel insert, formulated into an approximately 30" drill bit, with a variety of PCD chisel type inserts being located at various locations throughout the surface of the shown bit. The drill bit 280 is also formed having an inner flat face 282, and a variety of PCD chisel inserts, many as shown at 284, some arranged in a plowing mode, as at 286, and others arranged in a shearing mode, as shown in 288, as noted. The outer perimeter of the bit is sloped, at approximately a 28° angle, as at 290, and in this manner functions as the outer reamer portion of the bit, and usually this type of bit is one that is greater than 12" in diameter, and perhaps up to said 30" size.

Figure 28:
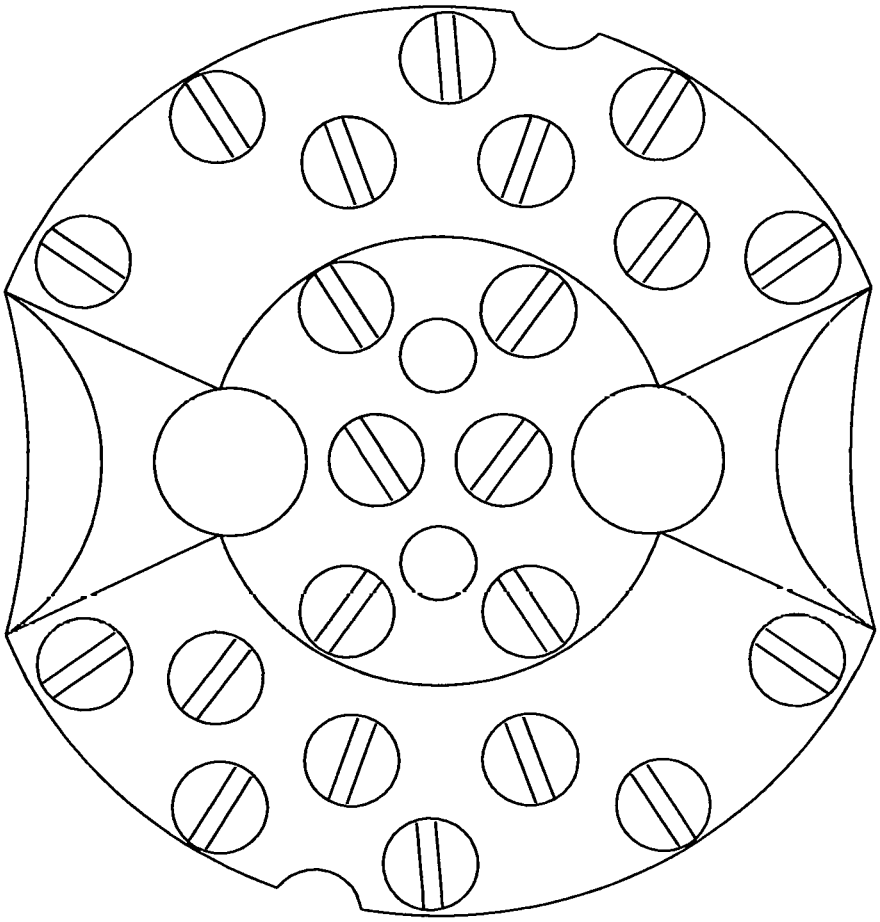
FIG. 28 shows another top view of a further and preferred embodiment of a percussion drill bit incorporating a series of PCD chisel inserts.

FIG. 28 shows a further and preferred embodiment for a percussion drill bit incorporating a series of PCD chisel inserts, where select of the chisel inserts are in both the plowing and shearing positions, upon the outer beveled surface of the drill bit, while others of the chiseled type inserts are provided upon the top flattened surface of the drill bit, and these also are either in a shearing or plowing direction, at this location of the shown bit.

Variations or modifications to the subject matter of this disclosure may occur to those skilled in the art upon review of the disclosure as described herein. Such variations, if within the spirit of this disclosure, are intended to be encompassed within the scope of any claims to patent protection issuing hereon. The description of the preferred embodiments, and its depiction in the drawings, are set forth for illustrative purposes only.

What is claimed is:

1. A rotary percussion drill bit, for drilling in the ground, the drill bit form having a body, the body capable of being secured with a drill shaft in preparation for a percussion drilling operation, the percussion drill bit comprising:

a cutting face having an inner flat face and an outer beveled peripheral surface;

a number of polycrystalline diamond chisel type inserts having a diameter applied to the inner flat face and the outer beveled peripheral surface of the drill bit;

each of the chisel type inserts having an upper transverse cutting edge, and the cutting edges of the chisel type inserts being arranged at a cutting angle of between about 0° to 45° off of the perpendicular of the arc of rotation of the percussion drill bit; and wherein select of said chisel type inserts of said percussion drill bit being arranged in a plowing mode, having the cutting edge aligned with the radius of the bit, others of said chisel type inserts being arranged in a slicing mode, having the cutting edge arranged at an angle beyond 0° and up to 30° off of the perpendicular to the arc of rotation of the percussion drill bit during performance of the percussion drilling operation.

2. The percussion drill bit of claim 1, wherein the outer beveled peripheral surface is beveled at 28° to 30° with respect to the inner flat face and forms a reamer portion of the drill bit.

3. The percussion drill bit of claim 1, wherein the number of polycrystalline diamond inserts inserted into the outer beveled peripheral surface is eight.

4. The percussion drill bit of claim 1, wherein the number of polycrystalline diamond inserts inserted into the inner flat face is at least four.

5. The percussion drill bit of claim 1, wherein the number of polycrystalline diamond inserts inserted into the inner flat face is thirteen.

6. The percussion drill bit of claim 1, wherein the diameter of select of the polycrystalline diamond chisel inserts is ⅝' to 1".

7. The percussion drill bit of claim 1, wherein the second diameter of select polycrystalline diamond chisel inserts is between ½" to 1".

8. The percussion drill bit of claim 1, wherein the cutting edges of each of the polycrystalline diamond chisel inserts are formed of polycrystalline diamond.

9. The percussion drill bit of claim 1, wherein the cutting edges of each of the polycrystalline diamond chisel inserts are arranged at an angle between about 0° to 15° degrees off of the perpendicular to the arc of rotation of the percussion drill bit.

10. The percussion drill bit of claim 1 further comprising a number of apertures in the inner flat face for providing for flow of a cleansing fluid.

11. The percussion drill bit of claim 1, wherein the outer beveled peripheral surface is beveled at 28° with respect to the inner flat face portion.

12. The percussion drill bit of claim 1 wherein the outer beveled peripheral surface is beveled at an angle of 28° relative to the inner flat face.

13. The percussion drill bit of claim 1, wherein the machine torque pressure generated is between about 20 Bar, and the machine thrust pressure generated is about 28 Bar.

14. The percussion drill bit of claim 1, wherein the drilling operation is percussion rotary drilling employed in drilling for oil.

15. The percussion drill bit of claim 1, wherein the drilling operation is down the hole percussion rotary drilling employed in drilling for oil.

16. The percussion drill bit of claim 1, wherein the diameter of each said percussion drill bit is between about 3 inches to 30 inches in diameter.

17. The percussion drill bit of claim 16, wherein said polycrystalline diamond tipped chisel inserts being coated with polycrystalline diamond to a thickness of between about 0.010 inch to 0.060 inch.

18. The percussion drill bit of claim 1 wherein said cutting face having an inner frontal flat face, a first ring face portion which is stepped down from the inner frontal flat face, a second ring face portion which is stepped down from the first ring face portion, and an outer beveled peripheral surface which is sloped relative to the second ring face portion; and a number of polycrystalline diamond chisel inserts inserted into the inner frontal flat face, the first ring face portion, the second ring face portion, and the outer beveled peripheral surface.

19. The percussion drill bit of claim 18, wherein the first ring face portion is stepped down from the inner frontal flat face up to ¼" and the second ring face portion is stepped down from the first ring face portion by up to ¼".

20. The percussion drill bit of claim 18, wherein the inner frontal flat face has six polycrystalline diamond chisel inserts, the first ring face portion has six polycrystalline diamond chisel inserts, the second ring face portion has nine polycrystalline diamond chisel inserts, and the outer beveled ring face portion has ten polycrystalline diamond chisel inserts.

21. The percussion drill bit of claim 18, wherein the outer beveled peripheral surface is beveled at 28° with respect to the inner frontal flat face.

22. The percussion drill bit of claim 21, wherein the polycrystalline diamond chisel inserts are up to 1" in diameter.

23. The percussion drill bit of claim 1, wherein the drilling operation is percussion rotary drilling employed in mining operations.

* * * * *